US008840738B2

(12) United States Patent
Murakami et al.

(10) Patent No.: US 8,840,738 B2
(45) Date of Patent: Sep. 23, 2014

(54) COLD-ROLLED STEEL SHEET AND METHOD FOR PRODUCING THE SAME

(75) Inventors: Toshio Murakami, Kobe (JP); Akira Ibano, Kobe (JP); Hideo Hata, Kobe (JP); Kenji Saito, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 50 days.

(21) Appl. No.: 13/258,823

(22) PCT Filed: Apr. 2, 2010

(86) PCT No.: PCT/JP2010/056096

§ 371 (c)(1),
(2), (4) Date: Sep. 22, 2011

(87) PCT Pub. No.: WO2010/114131

PCT Pub. Date: Oct. 7, 2010

(65) Prior Publication Data

US 2012/0012231 A1 Jan. 19, 2012

(30) Foreign Application Priority Data

| | | |
|---|---|---|
| Apr. 3, 2009 | (JP) | 2009-091297 |
| Apr. 3, 2009 | (JP) | 2009-091298 |
| Oct. 5, 2009 | (JP) | 2009-231680 |
| Oct. 5, 2009 | (JP) | 2009-231681 |

(51) Int. Cl.

| | |
|---|---|
| ***C21D 11/00*** | (2006.01) |
| ***C22C 1/00*** | (2006.01) |
| ***C21D 9/48*** | (2006.01) |
| ***C21D 9/46*** | (2006.01) |
| ***C21D 8/04*** | (2006.01) |
| *C22C 38/00* | (2006.01) |
| *C22C 38/04* | (2006.01) |
| *C22C 38/22* | (2006.01) |
| *C22C 38/44* | (2006.01) |

(52) U.S. Cl.

CPC ..... *C21D 8/0405* (2013.01); *C21D 2211/005* (2013.01); *C22C 1/002* (2013.01); *C21D 2211/008* (2013.01); *C21D 2211/003* (2013.01); *C21D 9/48* (2013.01); *C21D 9/46* (2013.01); *C21D 2211/001* (2013.01)

USPC ..... 148/504; 148/320; 148/332; 148/333; 148/336; 148/337

(58) Field of Classification Search

CPC .. C21D 8/0405; C21D 9/48; C21D 2211/001; C21D 2211/003; C21D 2211/005; C21D 2211/008

USPC ..... 148/320, 332, 333, 336, 337, 504

See application file for complete search history.

(56) References Cited

U.S. PATENT DOCUMENTS

| | | | | |
|---|---|---|---|---|
| 2009/0277547 | A1* | 11/2009 | Saito et al. | 148/661 |
| 2010/0247957 | A1* | 9/2010 | Hoshika et al. | 428/659 |
| 2010/0252147 | A1 | 10/2010 | Murakami et al. | |
| 2011/0005643 | A1 | 1/2011 | Murakami et al. | |

FOREIGN PATENT DOCUMENTS

| | | | | |
|---|---|---|---|---|
| JP | 63-293121 | | 11/1988 | |
| JP | 2002-161336 | A | 6/2002 | |
| JP | 2004-232022 | A | 8/2004 | |
| JP | 2004-256872 | A | 9/2004 | |
| JP | 2004256872 | A * | 9/2004 | C22C 38/00 |
| JP | 2004-277858 | | 10/2004 | |
| JP | 2004-359973 | | 12/2004 | |
| JP | 2007-302918 | | 11/2007 | |

OTHER PUBLICATIONS

U.S. Appl. No. 13/257,639, filed Sep. 20, 2011, Hata, et al.
International Search Report issued Jul. 6, 2010 in Patent Application No. PCT/JP2010/056095.

* cited by examiner

*Primary Examiner* — Keith Walker
*Assistant Examiner* — Alexander Polyansky
(74) *Attorney, Agent, or Firm* — Oblon, Spivak, McClelland, Maier & Neustadt, L.L.P.

(57) ABSTRACT

A cold-rolled steel sheet of the present invention which has a composition containing, in terms of % by mass, C: 0.05-0.30%, Si: 3.0% or less (including 0%), Mn: 0.1-5.0%, P: 0.1% or less (including 0%), S: 0.010% or less (including 0%), and Al: 0.001-0.10%, and remainder being mainly iron, and which has a structure comprising, in terms of area ratio, 10-80% ferrite, less than 5% (including 0%) of the sum of retained austenite and martensite, and a hard phase as the remainder. The steel sheet gives a KAM value frequency distribution curve in which the relationship between the proportion of frequency having a KAM value ≤0.4, $X_{KAM\leq 0.4°}$, and the area ratio of ferrite, $V_\alpha$ satisfies $X_{KAM\leq 0.4°}/V_\alpha \geq 0.8$ and the proportion of frequency having a KAM value in the range of 0.6-0.8, $X_{KAM=0.6\text{-}0.8°}$ is 10-20%. In the hard phase adjoining the ferrite, cementite, grains having an equivalent circle diameter of 0.1 μm or larger exist so that three or less such cementite grains are dispersed per $\mu m^2$ of the hard phase. The steel sheet has improved balance between elongation and stretch flangeability and has better formability.

18 Claims, 1 Drawing Sheet

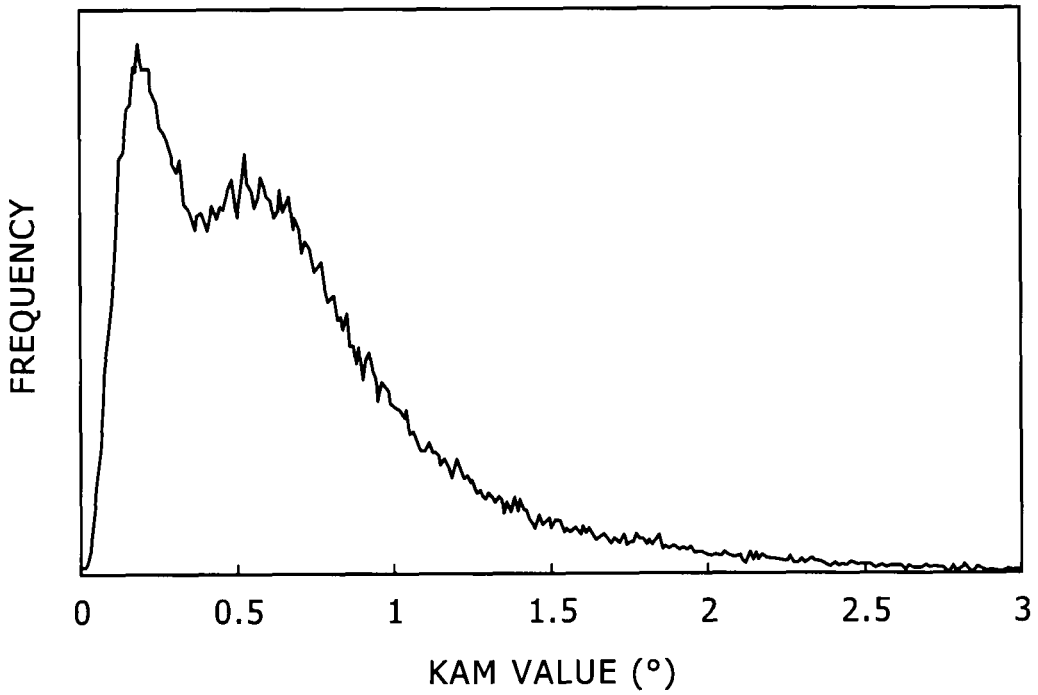
FREQUENCY
0
0.5
1
1.5
2
2.5
3
KAM VALUE (°)

COLD-ROLLED STEEL SHEET AND METHOD FOR PRODUCING THE SAME

This application is a National Stage of PCT/JP10/056,096 filed Apr. 2, 2010 and claims the benefit of JP 2009-091297 filed Apr. 3, 2009; JP 2009-091298 filed Apr. 3, 2009; JP 2009-231680 filed Oct. 5, 2009; and JP 2009-231681 filed Oct. 5, 2009.

TECHNICAL FIELD

The present invention relates to a high-strength cold-rolled steel sheet having excellent processability used for automotive parts and the like and a method for producing the same. Particularly, the present invention relates to a high-strength cold-rolled steel sheet having improved balance between elongation (total elongation) and stretch flangeability and a method for producing the same.

BACKGROUND ART

For example, for a steel sheet used for skeleton parts for automotives, high strength is required for the purpose of collision safety and fuel efficiency by forming lighter automotive as well as excellent processability for processing the skeleton parts having complicated shapes is also required.

Consequently, providing a high-strength steel sheet having tensile strength (TS) of 780 MPa class or more together with having improved balance between elongation (total elongation; El) and stretch flangeability (a hole expansion rate; λ) is earnestly required. For example, a steel sheet having tensile strength (TS) of 780 MPa or more, TS×El of 14000 MPa·% or more and TS×El×λ of 800000 MPa·%·% (more preferably TS of 780 MPa or more, TS×El of 15000 MPa·% or more and TS×El×λ of 1000000 MPa·%·% or more, and further preferably TS of 780 MPa or more, TS×El of 16000 MPa·% or more and TS×El×λ of 12000000 MPa·%·% or more) is required.

To accept the above-described requirements, a large number of high-strength steel sheets which have improved balance between elongation and stretch flangeability are suggested, based on various concepts for structure control. However, actual status is that only a few cases satisfy balance between the elongation and the stretch flangeability in the above-described required level.

For example, Patent Document 1 discloses a high-tension cold-rolled steel sheet including at least one of Mn, Cr and Mo of 1.6-2.5% by mass in total, substantially made of a single-phase structure of martensite. Although its hole expansion rate (stretch flangeability) λ of 100% or more is obtained in a steel sheet having tensile strength of 980 MPa class, its elongation El does not reach to 10%, and thereby the required level is not satisfied.

In Patent Document 2, a high-tension steel sheet made of two-phase structure which is made of ferrite of 65-85% in area ratio and remainder of tempering martensite is disclosed.

In Patent D 3, a high-tension steel sheet made of two-phase structure which has both of average crystal grain sizes of ferrite and martensite of 2 μM or less and includes martensite of 20% or more to less than 60% in a volume ratio is disclosed.

Any high-tension steel sheets disclosed in Patent Document 2 and Patent Document 3 ensure elongation exceeding 10% by mixing with large quantity of ferrite, which has high deformation ability, and some sheets satisfying the required level exist. Inventions according to these high-tension steel sheets is characterized in that an area proportion between ferrite and a hard phase, and grain sizes of these both phases are controlled. However, these inventions clearly differ from the present invention in technological idea which is characterized in that an amount of strain in ferrite, deformation ability of a hard phase, and further distribution state of cementite grains excising at an interface between the ferrite and the hard phase are controlled.

PRIOR ART DOCUMENT

Patent Document

Patent Document 1: Japanese Patent Application Publication No. 2002-161336

Patent Document 2: Japanese Patent Application Publication No. 2004-256872

Patent Document 3: Japanese Patent Application Publication No. 2004-232022

DISCLOSURE OF THE INVENTION

Problem to be Solved by the Invention

An object of the present invention is to provide a high-strength cold-rolled steel sheet having improved balance between elongation and stretch flangeability and better formability.

Means for Solving the Problem

The invention described in claim 1 is for a cold-rolled steel sheet, in which the cold-rolled steel sheet comprises:

a component composition comprising, in terms of % by mass (hereinafter, the unit is the same for chemical compositions), C: 0.05-0.30%, Si: 3.0% or less (including 0%), Mn: 0.1-5.0%, P: 0.1% or less (including 0%), S: 0.010% or less (including 0%) and Al: 0.001-0.10%, and remainder being iron and unavoidable impurities; and a structure comprising, in terms of area ratio:

10-80% of ferrite as a soft phase;

less than 5% (including 0%) of the sum of retained austenite, martensite and a mixed structure of retained austenite and martensite; and a hard phase made of tempering martensite and/or tempering bainite as the remainder, in a frequency distribution curve of a Kernel Average Misorientation value (hereinafter abbreviated as "KAM value"), a relation between a proportion of frequency having the KAM value of 0.4° or less to the total frequency $X_{KAM\leq 0.4°}$ (unit: %) and an area ratio of ferrite $V_\alpha$ (unit: %) satisfies $X_{KAM\leq 0.4°}/V_\alpha \geq 0.8$; and a proportion of frequency having the KAM value of 0.6-0.8° to the total frequency $X_{KAM=0.6\text{-}0.8°}$ is 10-20%, and a dispersion state of cementite grains having an equivalent circle diameter of 0.1 μm or more and existing at an interface between the ferrite and the hard phase is three grains or less per 1 $\mu m^2$ of the hard phase.

The invention described in claim 2 is for the cold-rolled steel sheet, in which the component composition further comprises one or more of Nb: 0.02-0.40%;

Ti: 0.01-0.20%; and

V: 0.01-0.20% satisfying [% Nb]/96+[% Ti]/51+[% V]/48)×48 of 0.01-0.20%, an average grain size of the ferrite is 5 μm or less in an equivalent circle diameter, and a distribution state of precipitate existing at an interface between the ferrite and the hard phase, having an equivalent circle diameter of 20 nm or more and comprising one or more of Nb, Ti and V is five precipitate grains or less per 1 $\mu m^2$ of the hard phase.

tempering temperature: 420° C. or more and 670° C. or less, and time which exists in a temperature region between [tempering heating temperature-10° C.]-tempering heating temperature (referred to as "tempering retention time") is set to 30 s or less and then cooled in a cooling rate exceeding 5° C./s.

[Mathematical Formula 1]

$$X = 1 - \exp\left(-\left(\int_{t_{600°C.}}^{t_{Ac1}} (\exp(0.8\ln(D_{Fe}) + 1.8\ln(\rho_o) - 33.7))^{1/0.58} \cdot dt\right)^{0.58}\right) \geqq 0.8 \quad \text{Formula I}$$

where $$D_{Fe} = 0.0118 \cdot \exp\left(-\frac{281500}{8.314 \cdot (T(t) + 273)}\right)$$

$$\rho_o = 1.54 \times 10^{15} \cdot \ln\left(-\ln\left(\frac{100 - [CR]}{100}\right)\right) + 2.51 \times 10^{14}$$

$$r = \left(\int_{t_{600°C.}}^{t_{Ac1}} 0.5 \cdot \exp\left(-\frac{80220}{8.314 \cdot (T(t) + 273)}\right) \cdot dt + r_0^3\right)^{\frac{1}{3}} \leqq 0.19 \quad \text{Formula II}$$

The invention described in claim 3 is for the cold-rolled steel sheet, in which the component composition further includes Cr: 0.01-1.0%.

The invention described in claim 4 is for the cold-rolled steel sheet, in which the component composition further includes one or more of Mo: 0.02-1.0%, Cu: 0.05-1.0% and Ni: 0.05-1.0%.

The invention described in claim 5 is that, for the cold-rolled steel sheet, the component composition further includes Ca: 0.0005-0.01% and/or Mg: 0.0005-0.01%.

The invention described in claim 6 is that a method for manufacturing a cold-rolled steel sheet comprising:

hot rolling a steel material comprising the component composition described in claim 1 under hot-rolling conditions (1) of finish temperature of finish rolling: equal to or more than an Ara point and take-up temperature: 450-700° C.;

cold rolling the hot-rolled steel sheet under a cold-rolling condition (2) of a cold rolling ratio: 20-80%;

annealing the cold-rolled steel sheet under annealing conditions (3)

in which after rising temperature in a temperature zone of 600-Ac1° C. by a temperature rising pattern which satisfies both of Formula I and Formula II and retaining for annealing retention time: 3600 s or less at annealing heating temperature of [(8×Ac1+2×Ac3)/10]-1000° C., the steel sheet is rapidly cooled in a cooling rate of 50° C./s or more from the annealing heating temperature to a temperature of Ms point or lower directly, or is slowly cooled in a cooling rate of 1° C./s or more and less than 50° C./s (referred to as a "first cooling rate") from the annealing heating temperature to temperature of lower than the annealing heating temperature and 600° C. or more (referred to as "first cooling finish temperature") and then is rapidly cooled in a cooling rate of 50° C./s or less (referred to as a "second cooling rate") to the temperature of Ms point or lower (referred to as "second cooling finish temperature"); and tempering the annealed steel sheet under tempering conditions (4)

in which the steel sheet is heated at a heating rate exceeding 5° C./s between temperature after the annealing cooling to tempering temperature: 420° C. or more and 670° C. or less, and time which exists in a temperature region between [tempering heating temperature-10° C.]-tempering heating temperature (referred to as "tempering retention time") is set to 30 s or less and then cooled in a cooling rate exceeding 5° C./s.

where, X: Recrystallization ratio (−), $D_{Fe}$: Self diffusion ratio of iron ($m^2/s$), $\rho_0$: Initial transition density ($m/m^3$), t: Time (s), $t_{Ac1}$: Time at point reached to Ac1 point (s), T(t): Temperature at time t (° C.), [CR]: Cold rolling ratio (%), r: Radius of cementite grain, and $r_0$: Initial radius of cementite grain (μm).

The invention described in claim 7 is a method for manufacturing a cold-rolled steel sheet comprising:

hot rolling a steel material comprising the component composition described in claim 2 under hot-rolling conditions (1) of finish temperature of finish rolling: $Ar_3$ point or more, and take-up temperature: 450° C.-700° C.;

cold rolling the hot-rolled steel sheet under a cold-rolling condition (2) of a cold rolling ratio: 20-80%;

annealing the cold-rolled steel sheet under annealing conditions (3)

in which after rising temperature in a temperature zone of 600-Ac1° C. by a temperature rising pattern which satisfies both of Formula I' and Formula II' and retaining for annealing retention time: 3600 s or less at annealing heating temperature of [(8×Ac1+2×Ac3)/10]−1000° C., the steel sheet is rapidly cooled in a cooling rate of 50° C./s or more from the annealing heating temperature to a temperature of Ms point or lower directly, or is slowly cooled in a cooling rate of 1° C./s or more and less than 50° C./s (referred to as a "first cooling rate") from the annealing heating temperature to a temperature of lower than the annealing heating temperature and 600° C. or more (referred to as "first cooling finish temperature") and then is rapidly cooled in a cooling rate of 50° C./s or less (referred to as a "second cooling rate") to the temperature of Ms point or lower (referred to as "second cooling finish temperature"); and tempering the annealed steel sheet under tempering conditions (4)

in which the steel sheet is heated at a heating rate exceeding 5° C./s between temperature after the annealing cooling to tempering temperature: between 420° C. or more and lower than 670° C., and time which exists in a temperature region between [tempering heating temperature-10° C.]-tempering heating temperature (referred to as "tempering retention time") is set to 30 s or less and then cooled in a cooling rate exceeding 5° C./s.

[Mathematical Formula 2]

$$X = 1 - \exp\left(-\left(\int_{t_{600°C.}}^{t_{Ac1}} (\exp(0.82\ln(D_{Fe}) + 1.8\ln(\rho_o) - 34.2))^{1/0.58} \cdot dt\right)^{0.58}\right) \geqq 0.8$$

Formula I′ where $$D_{Fe} = 0.0118 \cdot \exp\left(-\frac{281500}{8.314 \cdot (T(t) + 273)}\right)$$

$$\rho_o = 1.54 \times 10^{15} \cdot \ln\left(-\ln\left(\frac{100 - [CR]}{100}\right)\right) + 2.51 \times 10^{14}$$

$$r = \left(\int_{t_{600°C.}}^{t_{Ac1}} 0.15 \cdot \exp\left(-\frac{80220}{8.314 \cdot (T(t) + 273)}\right) \cdot dt + r_0^3\right)^{\frac{1}{3}} \leqq 0.19$$

Formula II′ where, X: Recrystallization ratio (−), $D_{Fe}$: Self diffusion ratio of iron ($m^2/s$), $\rho_0$: Initial transition density ($m/m^3$), t: Time (s), $t_{Ac1}$: Time at point reached to Ac1 point (s), T(t): Temperature at time t (° C.), [CR]: Cold rolling ratio (%), r: Radius of cementite grain, and $r_0$: Initial radius of cementite grain (μm).

Effects of the Invention

According to the present invention, in dual-phase structure steel mainly made of ferrite which is a soft phase and tempering martensite and/or tempering bainite which is a hard phase, an adequate amount of the hard phase which has high deformation ability is introduced as well as an amount of strain in ferrite is controlled, and moreover a distribution state of cementite grains existing in the interface between the ferrite and the hard phase are controlled. Thereby, stretch flangeability of a steel sheet can be improved with ensuring elongation, and a high-strength steel sheet having improved balance between elongation and stretch flangeability and better formability can be provided.

BRIEF DESCRIPTION OF THE DRAWINGS

FIG. 1 is a graph chart showing frequency distribution of a KAM value.

BEST MODES FOR CARRYING OUT THE INVENTION

The inventors of the present invention have focused attention on a high-strength steel sheet having a dual-phase structure made of ferrite which is a soft phase and tempering martensite and/or tempering bainite (hereinafter sometimes referred to as "tempering martensite and the like") which is a hard phase. The inventors have considered that if stretch flangeability can be improved with ensuring elongation, a high-strength steel sheet which satisfies the required level, and intensive investigation has been made for examining effect of various factors which affect the balance between strength and elongation and stretch flangeability. As a result, the present inventors have found that stretch flangeability can be improved with ensuring elongation by controlling deformation ability of the hard phase as well as controlling not only a ratio of ferrite but also an amount of strain in ferrite, and moreover, forming cementite precipitated at an interface between the ferrite and the hard phase to microscopic grains, and have accomplished the present invention based on these findings.

Hereinafter, a structure characterizing a steel sheet of the present invention is described.

[Structure of Steel Sheet of the Present Invention]

As described above, a steel sheet of the present invention is based on a dual-phase structure approximating the above-described Patent Documents 2 and 3. However, the steel sheet of the present invention is different from steel sheets in Patent Document 2 and 3 in that, particularly, deformation ability of the hard phase is controlled as well as an amount of strain in ferrite is controlled, and moreover, distribution state of cementite grains precipitated at the interface between the ferrite and the hard phase are controlled.

<Ferrite Being Soft Phase: 10-80% in Terms of Area Ratio>

In dual-phase structure steel such as ferrite-tempering martensite, the ferrite, which has high deformation ability, mainly takes charge of deformation. Therefore, elongation of the dual-phase structure steel such as ferrite-tempering martensite is mainly determined by an area ratio of the ferrite.

In order to ensure target elongation, 10% or more (preferably 15% or more, and more preferably 25% or more) of an area ratio of ferrite is needed. However, since strength of the steel cannot be ensured when an amount of ferrite is excessive, an area ratio of ferrite is set to 80% or less (preferably 70% or less, and more preferably 60% or less).

In dual-phase structure steel such as ferrite-tempering martensite, balance between strength and elongation depends on not only an area ratio of ferrite but also existence form of ferrite. More specifically, in a state in which ferrite grains are linked each other, stress is concentrated on a ferrite side which has high deformation ability, and only the ferrite takes charge of deformation, so that adequate balance between strength and elongation is difficult to obtain. On the other hand, when ferrite grains are surrounded by tempering martensite grains and/or bainite grains which are a hard phase, the hard phase also takes charge of deformation because the hard phase is forcibly deformed. As a result, the balance between strength and elongation is improved Existence form of ferrite, for example, can be evaluated by the number of points at which a line segment having a total length of 1000 μm is intersected with ferrite grain boundaries (interfaces between ferrite grains) or interfaces between ferrite-hard phase in a region of 40000 $\mu m^2$ or more. In order to exert the above-describe mechanism, preferable conditions of existence form of ferrite is that ("Intersection points with ferrite grain boundaries")/("Intersection points with ferrite grain boundaries"+"Intersection points with interfaces between ferrite-hard phase") is 0.5 or less.

<Retained Austenite, Martensite and Mixed Structure of Retained Austenite, Martensite: Total of Area Ratio being Less than 5% (Including 0%), Remainder: Structure Made of Tempering Martensite and/or Tempering Bainite being Hard Phase>

To prevent embrittlement with ensuring strength, it is effective that a region excluding ferrite is set to a structure in which martensite and/or bainite are mainly tempered (a structure made of tempering martensite and/or tempering bainite). On this occasion, when retained austenite and martensite which is not tempered (hereinafter, a description "martensite" means martensite which is not tempered) exist, stress is concentrated around them and the steel is easy to be fractured. Therefore, deterioration of stretch flangeability can be prevented by decreasing retained austenite, martensite and a mixed structure thereof as much as possible.

In order to exert the above-describe mechanism effectively, retained austenite, martensite and a mixed structure thereof is less than 5% (preferably 0%) in total of area ratio and remainder is a structure made of tempering martensite and/or tempering bainite which is a hard phase.

<Relation Between Ratio of KAM Value of 0.4° or Less $X_{KAM\leq 0.4°}$ and Area Ratio of Ferrite $V_\alpha$: $X_{KAM\leq 0.4°}/V_\alpha \geq 0.8$, Ratio of KAM Value of 0.6-0.8° $X_{KAM=0.6\text{-}0.8°}$: 10-20%>

Balance between strength and elongation in dual-phase structure steel is generally depends on an area ratio of ferrite and deformation ability of a hard phase. On the other hand, an amount of strain in ferrite largely affects to elongation, and thereby elongation lowers when the amount of strain is large in the case of constant area ratio of ferrite.

When only balance between strength and elongation is considered, the balance between strength and elongation can be ensured in a manner that decrease in elongation, which is caused by existence of strain in ferrite, is improved by increasing an area ratio of ferrite and strength is ensured by reducing a degree of tempering of the hard phase.

However, when stretch flangeability is also considered in addition to strength and elongation, it has been found that, if a process in which increase in the area ratio of ferrite and increase in strength of the hard phase is conducted in order to ensure the balance between strength and elongation with strain in ferrite remaining as described above, the stretch flangeability is deteriorated because the deformation ability of the hard phase is decreased and thereby the strain is concentrated at an interface between ferrite and the hard phase.

By this finding, it has been found that, when an amount of strain in ferrite is decreased as much as possible, an area ratio of the ferrite which requires to ensure balance between strength and elongation is decreased, and thereby deformation ability of the hard phase can be enhanced, so that stretch flangeability is improved, and as a result, balance among strength and elongation and stretch flangeability can be improved.

In other words, in order to ensure balance between elongation and stretch flangeability with ensuring constant strength, reducing an amount of strain in ferrite and enhancing deformation ability of the hard phase are the key points.

For evaluation of the amount of strain in ferrite and the deformation ability of the hard phase, using a KAM value is effective.

The KAM value is an average value of quantity of crystal rotation (crystal misorientation) between a target measuring point and measuring points around the target measuring point, and a large KAM value means that strain exists in the crystal. FIG. 1 exemplifies a frequency distribution curve of KAM values found by scanning a constant region in the steel of the present invention using a scanning electron microscope. The frequency distribution curve shows two peaks of the KAM value as shown in FIG. 1. The first peak shown around a KAM value of 0.2° is generated by strain in ferrite and the second peak shown around a KAM value of 0.6° is generated by strain in the hard phase. When strain in each phase becomes larger, each peak shifts to high KAM value side. On the other hand, for example, when the area ratio of ferrite is increased, height of the first peak becomes higher. To take these phenomena into consideration, each of $X_{KAM\leq 0.4°}/V_\alpha$ and $X_{KAM=0.6\text{-}0.8°}$ as indicators which simply represent an amount of strain in ferrite and deformation ability of the hard phase is introduced.

Here, $X_{KAM\leq 0.4°}$ is a proportion of frequency having a KAM value of 0.4° or less to the total frequency. $V_\alpha$ is an area ratio of the ferrite. $X_{KAM=0.6\text{-}0.8°}$ is a proportion of frequency having a KAM value of 0.6-0.8° to the total frequency.

Since $X_{KAM\leq 0.4°}$, that is, a proportion of frequency having the KAM value of 0.4° or less to the total frequency is considered as a function of the amount of strain in ferrite and the area ratio of ferrite from the above description, a value in which $X_{KAM\leq 0.4°}$ is divided by $V_\alpha$ is determined as the indicator representing the amount of the strain in the ferrite. When the amount of the strain in the ferrite is increased, a position of the first peak shifts to higher KAM value side and $X_{KAM\leq 0.4°}/V_\alpha$ becomes smaller.

In order to decrease the amount of strain in ferrite as much as possible, $X_{KAM\leq 0.4°}/V_\alpha$ is set to 0.8 or more (preferably 0.9 or more, and more preferably 1.1 or more). In other word, when $X_{KAM\leq 0.4°}$ is 30% or more, it means that 20% or more of ferrite having small strain exists.

$X_{KAM=0.6\text{-}0.8°}$, that is, a proportion of frequency having the KAM value of 0.6-0.8° to the total frequency represents an amount of the hard phase having high deformation ability. When this proportion is 10% or more, both of the amount of the hard phase and deformation ability which can ensure balance among strength and elongation and stretch flangeability are provided. On the other hand, when the proportion exceeds 20%, elongation cannot be ensured because the amount of the hard phase becomes too much.

A preferable range of $X_{KAM=0.6\text{-}0.8°}$ is 12-18% and a more preferable range is 13-16%.

<Dispersion State of Cementite Grains Having Equivalent Circle Diameter of 0.1 μm or More Existing in Hard Phase which Contacts to the Ferrite at its Interface: Three Grains or Less Per 1 $\mu m^2$ of the Hard Phase>

As described above, when fracture at an interface between ferrite and a hard phase is controlled by satisfying requirements for KAM values, it is a next starting point of fracture that is cementite precipitated in the hard phase which is in contact with the ferrite at its interface. When these cementite grains become rough and large, stress concentration becomes too large, and stretch flangeability cannot be ensured. Therefore, to control size of the cementite grains and existence density is needed in order to ensure stretch flangeability.

In order to ensure stretch flangeability, the number of rough and large cementite grains having a equivalent circle diameter of 0.1 μm or more is limited to three or less per 1 $\mu m^2$ of the hard phase, preferably 2.5 or less, and more preferably 2 or less.

Hereinafter, measuring methods for an area ratio of each phase, a KAM value, size and existence density of cementite grains, and existence form of ferrite are described.

[Measuring Method for Area Ratio of Each Phase]

First, for area ratio of each phase, an area of ferrite is determined in a manner that, after each sample steel sheet is ground to mirror surface and a metal structure is exposed by corrosion using 3% Nital solution, five viewing fields of regions having approximately 40 μm×30 μm is observed as scanning electron microscope (SEM) image having a magnification of 2000 and 100 points per viewing field are measured by a point counting method. A region containing cementite is determined as a hard phase by image analysis. The remaining region is determined as retained austenite, martensite and a mixed structure of retained austenite and martensite. The area ratios of each phase are calculated from area proportions of each region.

[Measuring Method of KAM Value]

A KAM value in each measuring point is determined in a manner that, after each sample steel sheet is ground to mirror surface and ground by electrolysis, electron backscattering diffraction image in a region of 500 μm×500 μm in a step of 0.2 μm is observed by a scanning electron microscope (XL30S-FEG, manufactured by Philips) and the image is analyzed by analysis software (OIM System, manufactured by TexSEM Laboratories Inc.)

[Measuring Method for Size and Existence Density of Cementite Grains]

Size of cementite grains and its existence density are determined in a manner that selected replica samples of each sample steel sheet is prepared, transmission electron microscope (TEM) images of three viewing fields having a region of 2.4 μm×1.6 μm being observed, white parts of the images being discriminated as cementite grains from contrast of the images and being marked, a equivalent circle diameter D ($D=2\times(A/\pi)^{1/2}$) being calculated from an area A of each of the marked cementite grains by image analysis software, and the number of predetermined size of cementite grains existing in a unit area being calculated. Parts in which a plurality of cementite grains are overlapped are excluded from the observation target.

[Measuring Method for Existence Form of Ferrite]

After each sample steel sheet is ground to mirror surface and a metal structure is exposed by corrosion using 3% Nital solution, 20 line segments having each length of 50 μm in each of ten viewing fields having regions of 80 μm×60 μm are drawn, and the number of ferrite grain boundary $N_\alpha$ and the number of interface between ferrite and a hard phase $N_\alpha+N_{\alpha\text{-}TM}$ which are intersected with these line segments are measured. Then, ratio of ferrite grain boundary occupied in grain boundaries and interfaces $N_\alpha/(N_\alpha+N_{\alpha\text{-}TM})$ is determined as an evaluation index for existence form of ferrite. Small value of $N_\alpha/(N_\alpha+N_{\alpha\text{-}TM})$ means that a region in which one ferrite grain and another ferrite grain is continuous is few, that is, ferrite grains are not continuous and are surrounded by hard phases.

Next, component compositions constituting a steel sheet of the present invention is described. Hereinafter, all units of chemical compositions are percent by mass.

[Component Compositions of Steel Sheet of the Present Invention]

C: 0.05-0.30%

C, which affects an area ratio of the hard phase and an amount of cementite precipitated in the hard phase and affects strength, elongation and stretch flangeability, is an important element. When a content of C is less than 0.05%, strength cannot be ensured. On the contrary, when the content of C exceeds 0.30%, in addition to generation of large strain at the time of quenching, transition is difficult to recover because an amount of cementite becomes high. As a result, an evaluation formula $X_{KAM=0.6\text{-}0.8°}\geq 10\%$, which represents a hard phase having high deformation ability due to less transition, cannot be obtained. When tempering conditions are set to high temperature or longer period in order to satisfy this evaluation formula, cementite becomes rough and large and thereby strength and stretch flangeability cannot be ensured.

A range of C content is preferably 0.10-0.25% and more preferably 0.14-0.20%.

Si: 3.0% or less (including 0%)

Si, which has an effect of suppressing formation of rough and large cementite grains at the time of tempering and contributes to satisfying both of elongation and stretch flangeability, is a useful element. When a content of Si exceeds 3.0%, an area ratio of the hard phase cannot be ensured and stretch flangeability cannot be ensured because formation of austenite at the time of heating is inhibited. A range of Si content is preferably 0.50-2.5% and more preferably 1.0-2.2%.

Mn: 0.1-5.0%

Mn, similar to Si, contributes to satisfying both of elongation and stretch flangeability by enhancing deformation ability of the hard phase in addition to having effect of suppressing formation of rough and large cementite grains at the time of tempering. In addition, an effect in which a range for manufacturing conditions for obtaining the hard phase is widened is also obtained by enhancing quenching property. When a content of Mn is less than 0.1%, since the above-described effect is not exerted sufficiently, both of elongation and stretch flangeability cannot be satisfied. On the contrary, when the content of Mn exceeds 5.0%, since reverse transformation temperature becomes too low and recrystallization cannot be achieved, balance between strength and elongation cannot be ensured. A range of Mn content is preferably 0.50-2.5% and more preferably 1.2-2.2%.

P: 0.1% or less

Although P unavoidably exists as an impurity element and contributes to increase in strength by solid solution strengthening, stretch flangeability is deteriorated due to segregation at former austenite grain boundary and embrittlement caused by the grain boundary. As a result, P content is set to 0.1% or less. A range of P content is preferably 0.05% or less and more preferably 0.03% or less.

S: 0.010% or less

Since S also unavoidably exists as an impurity element, forms MnS inclusion, and lowers stretch flangeability by forming starting points of cracks at the time of hole expansion, a content of S is set to 0.010% or less. A range of S content is preferably 0.005% or less and more preferably 0.003% or less.

N: 0.01% or less

Since N also unavoidably exists as an impurity element and lowers elongation and stretch flangeability due to strain aging, a content of N is preferably low and is set to 0.01% or less.

Al: 0.001-0.10%

Al is added as a deacidification element and has an effect to form inclusion in microscopic size. Also, Al is combined with N to form AlN and reduces dissolved N contributing to generation of strain aging, and thereby deterioration of elongation and stretch flangeability is prevented. When a content of Al is less than 0.001%, elongation and stretch flangeability cannot be ensured because strain aging is generated due to remaining dissolved N in steel. On the contrary, when the content of Al exceeds 0.1%, since formation of austenite at the time of heating is inhibited, an area ratio of the hard phase cannot be ensured, and thereby stretch flangeability cannot be ensured.

Steel of the present invention basically includes the above-described compositions, and remainder is substantially iron and impurities.

In the steel of the present invention, more preferable performance in which tensile strength TS is 780 MPa or more, TS×El being 16000 MPa·% and TS×El×λ being 1200000 MPa·%·% can be exerted by controlling a structure as described below as well as including one or more of Nb, Ti and V in a range as described below.

<One or More of Nb: 0.02-0.40%, Ti: 0.01-0.20%, V: 0.01-0.20% and [% Nb]/96+[% Ti]/51+[% V]/48×48)=0.01-0.02%>

Nb, Ti and V form microscopic MX-type compounds (collective term of carbide, nitride and carbonitride). This microscopic MX-type compounds contribute to form microscopic ferrite grains by affecting as grains which pin growth of austenite at the time of heating in annealing, and stretch flangeability is enhanced by forming microscopic structure after hot rolling. When each content of Nb, Ti and V and the total amount of V converted content exceed the above-described each upper limit, stretch flangeability is deteriorated because rough and large MX-type compounds are formed. Since these elements have an effect to strongly suppress recrystallization, $X_{KAM\leq 0.4°}/V_{\alpha}$ is less than 0.8 by suppressing recrystallization at the time of heating in annealing after cold rolling. Consequently, balance between strength and thereby elongation cannot be ensured. On the contrary, when each content of Nb, Ti and V and the total amount of V converted content exceed the above-described lower limits, effect of forming microscopic ferrite grains becomes insufficient.

<Average Grain Size of Ferrite: 5 μm or Less in Equivalent Circle Diameter>

Stretch flangeability is improved by increasing the number of sites in which stress tends to concentrate such as an interface between ferrite and a hard phase to disperse stress by forming microscopic ferrite grains.

In order to effectively exert the effect, an average grain size of ferrite is set to 5 μm or less, preferably 4 μm or less, and more preferably 3.5 μm or less in an equivalent circle diameter. As average grain size of ferrite becomes smaller, it is more preferable. However, a microscopic structure having an equivalent circle diameter of less than 0.2 μM is very difficult to obtain. Consequently, substantial lower limit of the average grain size is 0.2 μm in an equivalent circle diameter.

<Precipitate in which Distribution State of Precipitate Existing in the Hard Phase in Contact with an Interface with Ferrite is 20 Nm or More in an Equivalent Circle Diameter, and which Includes One or More of Nb, Ti and V: 5 or Less Per 1 $\mu m^2$ of the Hard Phase>

Precipitate including Nb, Ti or V such as NbC, TiC or VC has extremely high rigidity and critical shear stress compared to a parent phase and the precipitate itself is difficult to deform even if surrounding area of the precipitate is deformed. Therefore, when a size of the precipitate becomes 20 nm or more, large strain is generated at an interface of the parent phase and the precipitate and fracture occurs. Consequently, when rough and large precipitate including Nb, Ti and V having a size of 20 nm or more exist in large quantity, stretch flangeability is deteriorated. Accordingly, stretch flangeability can be improved by limiting existence density of the rough and large precipitates including Nb, Ti and V.

In order to effectively exert the effect, the rough and large precipitate which has an equivalent circle diameter of 20 nm or more and includes one or more of Nb, Ti and V is limited to five or less per 1 $\mu m^2$ of the hard phase, preferably 3 or less, and more preferably two or less.

Hereinafter, an average grain size of ferrite, a size of precipitate and existence density thereof are described.

[Measuring Method of Average Grain Size of Ferrite]

An equivalent circle diameter is calculated and determined from areas of each ferrite grain measured at the time of measurement of an area ratio described above.

[Measuring Method of a Size of Precipitate and Existence Density Thereof]

For a size of precipitate and existence density thereof, selected replica samples of each sample steel sheet is prepared, and transmission electron microscope (TEM) images of three viewing fields having a region of 2.4 μm×1.6 μm is observed, as similar to the measurement of cementite described above. For precipitate of 20 nm or more, only precipitates in which existence of Nb, Ti and V in the precipitate is confirmed using EDX or EELS associated with FE-TEM are counted.

In addition, the following acceptable compositions can be added to the steel of the present invention, as long as functions of the present invention is not impaired.

Cr: 0.01-1.0%

Cr, which can improve stretch flangeability by suppressing growth of cementite, is a useful element. When an amount of added Cr is less than 0.01%, the above function is not effectively exerted. On the contrary, when the amount of added Cr exceeds 1.0%, rough and large $Cr_7C_3$ is formed and thereby stretch flangeability is deteriorated.

One or More of Mo: 0.02-1.0%, Cu: 0.05-1.0% and Ni: 0.05-1.0%

These elements are useful elements for improving strength by solid solution strengthening without deteriorating formability. When amounts of added each element are less than the lower limit value, the above function is not effectively exerted. On the contrary, when the amounts of added each element exceed 1.0%, the cost becomes too high.

Ca: 0.0005-0.01% and/or Mg: 0.0005-0.01%

These elements are useful elements for improving stretch flangeability by forming microscopic inclusion and reducing starting points of fracture. When the amounts of added each element are less than 0.0005%, the above function is not effectively exerted. On the contrary, when the amounts of added each element exceed 0.01%, inclusion becomes rough and large on the contrary and thereby stretch flangeability becomes lower.

Next, hereinafter a preferable method for manufacturing in order to obtain the steel sheet of the present invention is described.

[Preferable Method for Manufacturing Steel Sheet of the Present Invention (Method 1)]

In order to manufacture a cold-rolled steel sheet described in claim 1 in the present invention, first, steel including the above-described component compositions is prepared by melting, and then hot rolling is performed after slab is formed by ingot casting or continuous casting. As conditions for the hot rolling, after finish temperature of finish rolling is set to $Ar_3$ or more and cooling is adequately performed, a steel sheet is taken up in a range of 450-700° C. After completion of hot rolling, the steel sheet is washed with acid, and then cold rolling is performed. A cold rolling ratio is preferably set to about 30% or more.

After the cold rolling, subsequently, annealing and tempering are performed.

[Annealing Conditions]

For annealing conditions, after rising temperature for a staying time of (Ac1-600) s or more in a temperature zone of 600-Ac1° C. and the steel sheet is retained for an annealing retention time: 3600 s or less at an annealing heating temperature: [(8×Ac1+2×Ac3)/10]−1000° C., the steel sheet is rapidly cooled in a cooling rate of 50° C./s or more from the annealing heating temperature to a temperature of Ms point or lower directly, or is slowly cooled in a cooling rate of 1° C./s or more and less than 50° C./s (a first cooling rate) from the annealing heating temperature to a temperature of lower than the annealing heating temperature and 600° C. or more (a first cooling finish temperature) and then is rapidly cooled in a cooling rate of 50° C./s or less (a second cooling rate) to the temperature of Ms point or lower (a second cooling finish temperature).

<Rising Temperature for Staying Time of (Ac1-600) s or More in Temperature Zone of 600-Ac1° C.>

This is done because recovery and recrystallization of ferrite is accelerated and strain in ferrite is released by staying for long period of time at high temperature zone before reverse transformation.

Temperature is preferably risen for a staying time of 200 s or more in a temperature zone of 600-Ac1° C., and more preferably risen for a staying time of 1000 s or more.

<Annealing Heating Temperature: Being Retained for Annealing Retention Time: 3600 s or Less at [(8×Ac1+2×Ac3)/10]−1000° C.>

This is done because, by transforming a region having an area ratio of 20% or more into austenite at the time of annealing heating, a sufficient amount of the hard phase is generated by transforming at the time of cooling thereafter.

When the annealing heating temperature is less than [(8×Ac1+2×Ac3)/10]° C., since an amount of transformation into austenite at the time of annealing heating is insufficient, the amount of the hard phase generated by transforming at the time of cooling thereafter can not be ensured. On the contrary, heating exceeding 1000° C. is industrially difficult in existing annealing equipment.

That the annealing retention time exceeds 3600 s is not preferable because the productivity is extremely worsened.

Preferable upper limit of the annealing heating temperature is [(1×Ac1+9×Ac3)/10]° C. When a mixed structure of ferrite and austenite is formed at the step of annealing heating, a final structure is a preferable structure in which ferrite is surrounded by the hard phase because the structure in which ferrite is surrounded by austenite is formed.

Preferable lower limit of retention time for annealing heating is 60 s. Strain in ferrite is further removed by setting heating time to longer period.

<Rapidly Cooling in a Cooling Rate of 50° C./s or More to a Temperature of Ms Point or Lower>

This is done because formation of ferrite from austenite in cooling is suppressed and the hard phase is obtained.

When the rapid cooling is completed at a temperature higher than Ms point or the cooling rate is lower than 50° C./s, bainite is formed, and thereby strength of a steel sheet cannot be ensured.

<Slow Cooling in a Cooling Rate of 1° C./s or More and Less than 50° C./s from the Heating Temperature to a Temperature of Lower than the Heating Temperature and 600° C. Or More>

This is done because elongation can be improved with ensuring stretch flangeability by forming a ferrite structure having less than 50% in an area ratio.

When the temperature is lower than 600° C. or the cooling rate is less than 1° C./s, excessive ferrite is formed and thereby strength and stretch flangeability cannot be ensured.

When the annealing heating temperature is Ac3-1000° C., preferably the steel is cooled in a rate of 1-50° C./s from the annealing heating temperature to 550° C. or more and 650° C. or less, and then rapidly cooled in a rate of higher than 50° C./s. When the temperature is 550° C. or less, characteristics are deteriorated by formation of bainite, and when temperature is 650° C. or more, the characteristics may not be ensured because a portion of ferrite is too low.

[Tempering Conditions]

As tempering conditions, the steel may be heated at a heating rate exceeding 5° C./s from the temperature after the annealing cooling to a tempering temperature between 420° C. or more and 670° C. or less, and may be cooled at a cooling rate exceeding 5° C./s after time which exists in a temperature region between [tempering heating temperature-10° C.]-tempering heating temperature (tempering retention time) is set to 30 s or less.

Reduction rate of strain (transition) in ferrite and a hard phase is strongly depends on temperature. On the other hand, size of cementite grains depends on time. Therefore, in order to reduce transition with releasing strain, it is effective that temperature in tempering is set to be high and staying time is set to be short.

When the heating rate or the cooling rate is 5° C./s or less, generation and growth of cementite nucleus during heating or cooling is generated and rough and large cementite is formed, and thereby stretch flangeability cannot be ensured.

When the tempering heating temperature is lower than 420° C., strain in ferrite or the hard phase is large, and thereby elongation and stretch flangeability cannot be ensured.

On the contrary, when the tempering heating temperature is 670° C. or more or tempering retention time exceeds 30 s, strength of the hard phase is insufficient, and thereby strength of the steel sheet cannot be ensured, or cementite becomes rough and large, and thereby stretch flangeability is deteriorated.

A preferable range of the tempering heating temperature is 450° C. or more and lower than 650° C., and more preferably 500° C. or more and lower than 600° C. A preferable range of the tempering retention time is 10 s or less, more preferably 5 s or less.

[Preferable Method for Manufacturing Steel Sheet of the Present Invention (Method 2)]

In [Preferable method for manufacturing steel sheet of the present invention (Method 1)] described above, its [annealing conditions] are defined as "rising temperature for a staying time of (Ac1-600) s or more in a temperature zone of 600-Ac1° C.". However, a temperature zone of 600-Ac1° C. is more preferably risen by a temperature rising pattern which satisfies both of Formula I and Formula II described below. Other manufacturing conditions are similar to [Preferable method for manufacturing steel sheet of the present invention (Method 1)] described above. However, although a cold rolling ratio in cold rolling is "preferably set to about 30% or more" in the [Preferable method for manufacturing steel sheet of the present invention (Method 1)] described above, in this example, the ratio is set to in the range of 20-80%, in which Formula 3 representing a relation with initial transition density described below is effected.

[Mathematical Formula 3]

$$X = 1 - \exp\left(-\left(\int_{t_{600°C.}}^{t_{Ac1}} (\exp(0.8\ln(D_{Fe}) + 1.8\ln(\rho_o) - 33.7))^{1/0.58} \cdot dt\right)^{0.58}\right) \geqq 0.8 \quad \text{Formula I}$$

where $$D_{Fe} = 0.0118 \cdot \exp\left(-\frac{281500}{8.314 \cdot (T(t) + 273)}\right)$$

$$\rho_o = 1.54 \times 10^{15} \cdot \ln\left(-\ln\left(\frac{100 - [CR]}{100}\right)\right) + 2.51 \times 10^{14}$$

$$r = \left(\int_{t_{600°C.}}^{t_{Ac1}} 0.5 \cdot \exp\left(-\frac{80220}{8.314 \cdot (T(t) + 273)}\right) \cdot dt + r_0^3\right)^{\frac{1}{3}} \leqq 0.19 \quad \text{Formula II}$$

where, X: Recrystallization ratio (–), $D_{Fe}$: Self diffusion ratio of iron ($m^2/s$), $\rho_0$: Initial transition density ($m/m^3$), t: Time (s), $t_{Ac1}$: Time at point reached to Ac1 point (s), T(t): Temperature at time t (° C.), [CR]: Cold rolling ratio (%), r: Radius of cementite grain, and $r_0$: Initial radius of cementite grain (μm).

The inventors are set to "rising temperature for a staying time of (Ac1-600) s or more in a temperature zone of 600-Ac1° C." in [Preferable method for manufacturing steel sheet of the present invention (Method 1)] described above for the purpose of accelerating recovery and recrystallization of ferrite and releasing strain in ferrite by staying for long period of time at high temperature zone before reverse transformation at the time of annealing.

However, according to subsequent investigation conducted by the inventors, it has been found that cementite which precipitates at the time of cooling after preparing steel by melting and cooling after hot rolling may remain in a structure of a steel sheet before annealing, and the remaining cementite in the structure of the steel sheet becomes rough and large at the time of temperature rising in annealing. Since the rough and large cementite remains after tempering treatment, stretch flangeability of the steel sheet after heat treatment may be deteriorated.

Consequently, the inventors consider that such a temperature rising pattern that not recovery and recrystallization of ferrite being simply accelerated, but recovery and recrystallization of ferrite being accelerated with preventing formation of rough and large cementite remaining in the structure of the steel sheet before annealing is required to be employed for more preferable annealing conditions.

In order to determine such a temperature rising pattern in good accuracy, a recrystallization ratio X as an index quantitatively representing degree of recovery and recrystallization of ferrite and a radius of cementite grain r as an index quantitatively representing formation of rough and large cementite are employed. First, an effect of treatment temperature and treatment time affecting these indices is investigated.

Here, the inventors have found that the recrystallization ratio X is represented by Formula 1 described below, as a result of investigation of the effect of recrystallization temperature and time using materials for which initial transition density $\rho_0$ is changed by changing the cold rolling ratio.

$$X=1-\exp[-\exp\{A_1 \ln(D_{Fe})+A_2 \ln(\rho_0)-A_3\}\cdot t^n] \quad \text{Formula 1:}$$

(where, $A_1$, $A_2$, $A_3$ and n: Constants)

It is known that the relation of a self diffusion ratio of iron $D_{Fe}$ in Formula 2 is effected:

$$D_{Fe}=0.0118\exp[-281500/\{R(T+273)\}](m^2/s) \quad \text{Formula 2:}$$

(where, T: Temperature (° C.), R: Gas constant [=8.314 J/K·mol]) (For example, refer to Tekkou Binran (Steel Handbook), 3rd Ed., I Basics, Edited by The Iron and Steel Institution of Japan, Marzen, 1981, P. 349)

For the initial transition density $\rho_0$, it has been found that $\rho_0$ can be represented by the Formula 3 described below as a result of investigation of correlation between the initial transition density $\rho_0$ and the cold rolling ratio [CR] using a steel sheet formed by applying cold rolling to each steel material at a cold rolling ratio of 20-80%. A method disclosed in Japanese Patent Application Publication No. 2008-144233 is used for measurement of transition density.

$$\rho_0=B_1 \ln[(-\ln\{(100-[CR])/100\}]+B_2 \quad \text{Formula 3:}$$

(where, $B_1$ and $B_2$: Constants)

As a result of determining constants $B_1$ and $B_2$ in Formula 3 based on the investigation, $B_1=1.54\times10^{15}$ and $B_2=2.51\times10^{14}$ are obtained in the range of [CR]: 20-80%.

On the other hand, it has been known that a radius of cementite grain r is grown based on third power law of r and can be simply written down as Formula 4 described below. (For example, refer to Nippon Kinzoku Gakkai Kaihou (Bulletin of the Japan Institute of Metals), Kento Sakuma, Vol. 20, 1981, P. 247).

$$r^3-r_0^3=A\cdot\exp[-Q/\{R(T+273)\}]\cdot t \quad \text{Formula 4:}$$

(where, A and Q: Constants)

The following test is conducted in order to determine values of each constant in the relational formulae.

Two types of cold-rolled steel sheets which include C: 0.17%, Si: 1.35% and Mn: 2.0% in the range of component compositions of the present invention are used as test samples. One type of cold-rolled steel sheet is a cold-rolled steel sheet (thickness: 1.6 mm) formed by only cold rolling at a cold rolling ratio of 36% using an actual machine (slowly rising temperature before tempering treatment). The other type of cold-rolled steel sheet is a cold-rolled steel sheet in which the cold-rolled steel sheet having a cold rolling ratio of 36% made by the actual machine is further cold rolled at a cold rolling ratio of 60%.

The two types of cold-rolled steel sheets are heat treated in a heating pattern of "rapid heating+retaining for predetermined time at constant temperature+rapid cooling" in combination with various retention temperatures and retention times. Hardness of each steel sheet before and after the heat treatment is measured. Since it is considered that change in the hardness and a recrystallization ratio have strong correlation, the recrystallization ratio is calculated by a definitional formula of Recrystallization ratio=(Hardness before heat treatment−Hardness after heat treatment)/(Hardness before heat treatment−180 Hv). Here, 180 Hv in the definitional formula is the lowest hardness which is not softened any more when heat treatment is conducted by sequentially extending retention time in a state of the highest retention temperature. This hardness corresponds to hardness having a state in which the sample is sufficiently annealed to complete recrystallization and is completely softened.

As a result of determining the constants $A_1$, $A_2$, $A_3$ and n in Formula 1 by plotting data of the thus calculated recrystallization ratio X in Avrami plot as relation between retention temperature T and retention time t, $A_1$=0.8, $A_2$=1.8, $A_3$=33.7 and n=0.58 are obtained.

For the two types of cold-rolled steel sheets, each of the average radius $r_0$ and r of cementite grains existing in the structure of the steel sheet before and after the heat treatment conducted in combination with various retention temperatures T and retention times t is measured. As a result of determining constants A and Q in Formula 4 by plotting $(r^3-r_0^3)/t$ to 1/T as Arhenius Plot, A=0.5 and Q=80220 are obtained.

Since Formula 1 and Formula 4 are formulae in which T is constant, so as to be possible to apply these formulae to temperature rising process, the temperature is changed into temperature T(t) as a function of time t and formulae is transformed by integrating by staying time in the range of 600-Ac1° C. Thus, Formula I and Formula II are derived.

For steel sheets which are heat treated in various annealing conditions, a recrystallization ratio X and a radius of cementite grain r calculated by using Formula I and Formula II derived as described above and a state of recrystallization and a state of formation of rough and large cementite grains confirmed by observing the structure of the steel sheet after actual heat treatment are compared. Since both are excellently accorded with each other, it is confirmed that prediction accuracy of the recrystallization ratio X and the radius of cementite grain r according to Formula I and Formula II is sufficiently high.

The relation between the recrystallization ratio X and the radius of cementite grain r, which is calculated using Formula I and Formula II, and mechanical properties of the steel sheet after heat treatment (annealing+tempering), is also investigated. From the result of the investigation, for more preferable annealing conditions, a combination of X and r in which a value of TS×El×λ of the steel sheet after heat treatment is 1500000 MPa·%·% or more, which is further higher than the required level described in above [BACKGROUND ART], is calculated. As a result, X≥0.8 and r≤0.19 are obtained.

By employing a temperature rising pattern which satisfies both of X≥0.8 and r≥0.19, both of acceleration of recovery and recrystallization of ferrite and prevention from formation of rough and large cementite are possible. Moreover, a steel sheet having excellent balance of mechanical properties is obtained.

[Preferable Method for Manufacturing Steel Sheet of the Present Invention (Method 3)]

When a cold-rolled steel sheet in claim 2 of the present invention, that is, a cold-rolled steel sheet including one or more Nb, Ti and V is produced, first, steel including the above-described component compositions is prepared by melting, and then hot rolling is performed after forming slab by ingot casting or continuous casting.

[Hot Rolling Conditions]

As hot rolling conditions, after hot rolling at finish temperature of finish rolling: 900° C. or more, cooling is performed for cooling time: [(finish temperature of finish rolling-550° C.)/20] s or less up to 550° C., and then the steel sheet is taken up at take-up temperature: 500° C. or less.

After an MX-type compound is made not to generate precipitation during hot rolling, the MX-type compound is finely precipitated during a heating process at the time of annealing after the hot rolling. Thereby, microscopic structure can be formed without generating starting points of fracture, and thereby stretch flangeability can be improved.

<Finish Temperature of Finish Rolling: 900° C. Or More>

When the finish temperature of finish rolling is lower than 900° C., the MX-type compound is precipitated during the hot rolling. The precipitate grows to form rough and large precipitates during heating process at the time of annealing thereafter, and thereby stretch flangeability is deteriorated.

<Cooling Time to 550° C. After Hot Rolling: [(Finish Temperature of Finish Rolling-550° C.)/20] s or Less>

When the cooling time to 550° C. after completion of finish rolling exceeds [(finish temperature of finish rolling-550° C.)/20] s, transformation of ferrite is caused during cooling. Precipitate is formed in the formed ferrite. The precipitates form rough and large precipitates during heating process at the time of annealing thereafter, and thereby stretch flangeability is deteriorated.

<Take-Up Temperature: 500° C. Or Less>

When the take-up temperature exceeds 500° C., precipitate is formed or rough and large precipitate is generated during take-up, and thereby stretch flangeability is deteriorated.

After completion of hot rolling, the steel sheet is washed with acid, and then cold rolling is performed. A cold rolling ratio is preferably set to about 30% or more. After the cold rolling, subsequently, annealing and tempering are performed.

[Annealing Conditions]

For annealing conditions, after rising temperature for a staying time of (Ac1-600) s or more in a temperature zone of 600-Ac1° C. and the steel sheet is retained for an annealing retention time: 3600 s or less at an annealing heating temperature: [(8×Ac1+2×Ac3)/10]−1000° C., the steel sheet is rapidly cooled in a cooling rate of 50° C./s or more from the annealing heating temperature to a temperature of Ms point or lower directly, or is slowly cooled in a cooling rate of 1° C./s or more and less than 50° C./s (a first cooling rate) from the annealing heating temperature to a temperature of lower than the annealing heating temperature and 600° C. or more (a first cooling finish temperature) and then is rapidly cooled in a cooling rate of 50° C./s or less (a second cooling rate) to the temperature of Ms point or lower (a second cooling finish temperature).

<Rising Temperature for Staying Time of (Ac1-600) s or More in Temperature Zone of 600-Ac1° C.>

This is because recovery and recrystallization of ferrite is accelerated and strain in ferrite is released by staying for long period of time at high temperature zone before reverse transformation. Particularly, since microalloy (Nb, Ti and V) which delays recrystallization is added, longer staying time at a temperature zone of Ac1 point or lower is required.

Temperature is preferably risen in a temperature zone of 600-Ac1° C. for a staying time of [2×(Ac1-600)+200] s or more, and more preferably risen for a staying time of [2×(Ac1-600)+1000] s.

<Annealing Heating Temperature: Being Retained for Annealing Retention Time: 3600 s or Less at [(8×Ac1+2×Ac3)/10]−1000° C.>

This is because, by transforming a region having an area ratio of 20% or more into austenite at the time of annealing heating, a sufficient amount of the hard phase is generated by transforming at the time of cooling thereafter.

When the annealing heating temperature is less than [(8×Ac1+2×Ac3)/10]° C., since an amount of transformation into austenite at the time of annealing heating is insufficient, the amount of the hard phase generated by transforming at the time of cooling thereafter cannot be ensured. On the contrary, heating exceeding 1000° C. is industrially difficult in existing annealing equipment.

That the annealing retention time exceeds 3600 s is not preferable because the productivity is extremely worsened.

Preferable upper limit of the annealing heating temperature is [(1×Ac1+9×Ac3)/10]° C. When a mixed structure of ferrite and austenite is formed at the step of annealing heating, a final structure is a preferable structure in which ferrite is surrounded by the hard phase because the structure in which ferrite is surrounded by austenite is formed.

Preferable lower limit of retention time for annealing heating is 60 s. Strain in ferrite is further removed by setting heating time to longer period.

<Rapidly Cooling in a Cooling Rate of 50° C./s or More to a Temperature of Ms Point or Lower>

This is because formation of ferrite from austenite in cooling is suppressed and the hard phase is obtained.

When the rapid cooling is completed at a temperature higher than Ms point or the cooling rate is lower than 50° C./s, bainite is formed, and thereby strength of a steel sheet cannot be ensured.

<Slow Cooling in a Cooling Rate of 1° C./s or More and Less than 50° C./s from the Heating Temperature to a Temperature of Lower than the Annealing Heating Temperature and 600° C. Or More>

This is because elongation can be improved with ensuring stretch flangeability by forming a ferrite structure having less than 50% in an area ratio.

When the temperature is lower than 600° C. or the cooling rate is less than 1° C./s, excessive ferrite is formed and thereby strength and stretch flangeability cannot be ensured.

When the annealing heating temperature is Ac3-1000° C., preferably the steel is cooled in a rate of 1-50° C./s from the annealing heating temperature to 550° C. or more and 650° C. or less, and then rapidly cooled in a rate of higher than 50° C./s. When the temperature is 550° C. or less, characteristics are deteriorated by formation of bainite, and when temperature is 650° C. or more, the characteristics may not be ensured because a portion of ferrite is too low.

[Tempering Conditions]

As tempering conditions, the steel may be heated at a heating rate exceeding 5° C./s from the temperature after the annealing cooling to a tempering temperature between 420° C. or more and 670° C. or less, and may be cooled at a cooling rate exceeding 5° C./s after time which exists in a temperature region between [tempering heating temperature-10° C.]-tempering heating temperature (tempering retention time) is set to 20 s or less.

Reduction rate of strain (transition) in ferrite and a hard phase heavily depends on temperature. On the other hand, size of cementite grain is depends on time. Therefore, in order to reduce transition with releasing strain, it is effective that temperature in tempering is set to higher and staying time is set to short.

When the heating rate or the cooling rate is 5° C./s or less, generation and growth of cementite nucleus during heating or cooling is generated and rough and large cementite is formed, and thereby stretch flangeability cannot be ensured.

When the tempering heating temperature is lower than 420° C., strain in ferrite or the hard phase is large, and thereby elongation and stretch flangeability cannot be ensured. On the contrary, when the tempering heating temperature is 670° C. or more or tempering retention time exceeds 20 s, strength of the hard phase is insufficient, and thereby strength of the steel sheet cannot be ensured.

A preferable range of the tempering heating temperature is 450° C. or more and lower than 650° C., and more preferably 500° C. or more and lower than 650° C. A preferable range of the tempering retention time is 10 s or less, more preferably 5 s or less.

[Preferable Method for Manufacturing Steel Sheet of the Present Invention (Method 4)]

In [Preferable method for manufacturing steel sheet of the present invention (Method 3)] described above, its [annealing conditions] are defined as "rising temperature for a staying time of (Ac1-600) s or more in a temperature zone of 600-Ac1° C.". However, a temperature zone of 600-Ac1° C. is more preferably risen by a temperature rising pattern which satisfies both Formula I' and Formula II' described below. Other manufacturing conditions are similar to [Preferable method for manufacturing steel sheet of the present invention (Method 3)] described above. However, although a cold rolling ratio in cold rolling is "preferably set to about 30% or more" in the [Preferable method for manufacturing steel sheet of the present invention (Method 3)] described above, in this example, the ratio is set to in the range of 20-80%, in which Formula 7 representing a relation with initial transition density described below is effected.

[Mathematical Formula 4]

$$X = 1 - \exp\left(-\left(\int_{t_{600°C.}}^{t_{Ac1}} (\exp(0.82\ln(D_{Fe}) + 1.8\ln(\rho_o) - 34.2))^{1/0.58} \cdot dt\right)^{0.58}\right) \geqq 0.8 \quad \text{Formula I'}$$

where $$D_{Fe} = 0.0118 \cdot \exp\left(-\frac{281500}{8.314 \cdot (T(t) + 273)}\right)$$

$$\rho_o = 1.54 \times 10^{15} \cdot \ln\left(-\ln\left(\frac{100 - [CR]}{100}\right)\right) + 2.51 \times 10^{14}$$

$$r = \left(\int_{t_{600°C.}}^{t_{Ac1}} 0.15 \cdot \exp\left(-\frac{80220}{8.314 \cdot (T(t) + 273)}\right) \cdot dt + r_0^3\right)^{\frac{1}{3}} \leqq 0.19 \quad \text{Formula II'}$$

where, X: Recrystallization ratio (–), $D_{Fe}$: Self diffusion ratio of iron ($m^2/s$), $\rho_0$: Initial transition density ($m/m^3$), t: Time (s), $t_{Ac1}$: Time at point reached to Ac1 point (s), T(t): Temperature at time t (° C.), [CR]: Cold rolling ratio (%), r: Radius of cementite grain, and $r_0$: Initial radius of cementite grain (μm).

More specifically, similarly to [Preferable method for manufacturing steel sheet of the present invention (Method 2)] described above, a temperature rising pattern, in which not only recovery and recrystallization of ferrite are simply accelerated but recovery and recrystallization of ferrite are accelerated with preventing formation of rough and large cementite remaining in the structure of the steel sheet before annealing, is required for more preferable annealing conditions.

In order to determine such temperature rising pattern with good accuracy, similarly to [Preferable method for manufacturing steel sheet of the present invention (Method 2)] described above, a recrystallization ratio X as an index quantitatively representing degree of recovery and recrystallization of ferrite and a radius of cementite grain r as an index quantitatively representing formation of rough and large cementite are employed. First, an effect of treatment temperature and treatment time affecting these indices is investigated.

Here, as described above, the recrystallization ratio X is represented by the Formula 5 described below, as a result of investigation of the effect of recrystallization temperature and time using materials for which initial transition density $\rho_0$ is changed by changing a cold rolling ratio.

$$X=1-\exp[\exp\{A_1\ln(D_{Fe})+A_2\ln(\rho_0)-A_3\}\cdot t^n] \quad \text{Formula 5:}$$

(where, $A_1$, $A_2$, $A_3$ and n: Constants)

It is known that, as described above, relation of a self diffusion ratio of iron $D_{Fe}$ in Formula 6 is effected:

$$D_{Fe}=0.0118\exp[-281500/\{R(T+273)\}](m^2/s) \quad \text{Formula 6:}$$

(where, T: Temperature (° C.), R: Gas constant [=8.314 J/K·mol])

Also for the initial transition density $\rho_0$, as described above, it has been found that $\rho_0$ can be represented by the Formula 4 described below as a result of investigation of correlation between the initial transition density $\rho_0$ and cold rolling ratio [CR] using a steel sheet formed by applying cold rolling to each steel material at a cold rolling ratio of 20-80%.

$$\rho_0=B_1\ln[(-\ln\{(100-[CR])/100\}]+B_2 \quad \text{Formula 7:}$$

(where, $B_1$ and $B_2$: Constants)

For values of $B_1$ and $B_2$ in Formula 7, as described above, $B_1=1.54\times10^{15}$ and $B_2=2.51\times10^{14}$ are obtained in the range of [CR]: 20-80%.

On the other hand, as described above, it has been known that a radius of cementite grain r is grown based on third power law of r and can be simply written down as Formula 8 described below.

$$r^3-r_0^3=A\cdot\exp[-Q/\{R(T+273)\}]\cdot t \quad \text{Formula 8:}$$

(where, A and Q: Constants)

For steel materials including one or more Nb, Ti and V, the following test is conducted in order to determine values of each constant in the relational formulae.

Two types of cold-rolled steel sheets which includes C: 0.17%, Si: 1.35%, Mn: 2.0%, Nb: 0%, Ti: 0.04% and V: 0% being in the range of component compositions of the present invention are used as test samples. One type of cold-rolled steel sheet is a cold-rolled steel sheet (thickness: 1.6 mm) formed by only cold rolling at a cold rolling ratio of 36% using an actual machine (slowly rising temperature before tempering treatment). The other type of cold-rolled steel sheet is a cold-rolled steel sheet in which the cold-rolled steel sheet having a cold rolling ratio of 36% made by the actual machine is further cold rolled at a cold rolling ratio of 60%.

The two types of cold-rolled steel sheets are heat treated in a heating pattern of "rapid heating+retaining for predetermined time at constant temperature+rapid cooling" in combination with various retention temperatures and retention times. Hardness of each steel sheet before and after the heat treatment is measured. Since it is considered that change in the hardness and a recrystallization ratio has strong correlation, a recrystallization ratio is calculated by a definitional formula of Recrystallization ratio=(Hardness before heat treatment−Hardness after heat treatment)/(Hardness before heat treatment−180 Hv). Here, 180 Hv in the definitional formula is the lowest hardness which is not softened any more when heat treatment is conducted by sequentially extending retention time in a state of the highest retention temperature. This hardness corresponds to hardness having a state in which the sample is sufficiently annealed to complete recrystallization and is completely softened.

As a result of determining the constants $A_1$, $A_2$, $A_3$ and n in Formula 5 by plotting data of thus calculated recrystallization ratio X in Avrami plot as relation between retention temperature T and retention time t, $A_1=0.82$, $A_2=1.8$, $A_3=34.2$ and n=0.58 are obtained.

For the two types of cold-rolled steel sheets, each average radius $r_0$ and r of cementite grains existing in the structure of the steel sheet before and after the heat treatment conducted in combination with various retention temperatures T and retention times t is measured. As a result of determining constants A and Q in Formula 4 by plotting $(r^3-r_0^3)/t$ to 1/T as Arhenius Plot, A=0.15 and Q=80220 are obtained.

Since Formula 5 and Formula 8 are formulae in which T is constant, temperature is changed to temperature T(t) as a function of time t and formulae are transformed by integrating by staying time in the range of 600-Ac1° C. so as to be possible to apply these formulae to temperature rising process. Thus, Formula I' and Formula II' are derived.

For steel sheets which are heat treated in various annealing conditions, a recrystallization ratio X and a radius of cementite grain r calculated by using Formula I and Formula II' derived as described above and a state of recrystallization and a state of formation of rough and large cementite grains confirmed by observing the structure of the steel sheet after actual heat treatment are compared. Since both are excellently accorded with each other, it is confirmed that prediction accuracy of the recrystallization ratio X and the radius of cementite grains r according to Formula I' and Formula II' is sufficiently high.

The relation between the recrystallization ratio X and the radius of cementite grain r, which is calculated using Formula I' and Formula II', and mechanical properties of the steel sheet after heat treatment (annealing+tempering) is also investigated. From the result of the investigation, for more preferable annealing conditions, a combination of X and r in which a value of TS×El×λ of the steel sheet after heat treatment is 1800000 MPa·%·% or more, which is further higher than the required level described in the above [BACKGROUND ART], is calculated. As a result, X≥0.8 and r≤0.19 are obtained.

By employing a temperature rising pattern which satisfies both of X≥0.8 and r≤0.19, both of acceleration of recovery and recrystallization of ferrite and prevention from formation of rough and large cementite are possible. Moreover, a steel sheet having excellent balance of mechanical properties is obtained.

EXAMPLES

Example 1

Steel having compositions shown in Table 1 described below was prepared by melting, and ingot having a thickness of 120 mm was prepared. A thickness of the ingot was reduced to 25 mm by hot rolling, and reduced again to 3.2 mm by hot rolling. A test material was prepared in a manner that this steel sheet was washed with acid and its thickness was reduced to 1.6 mm by cold rolling. Heat treatment under the conditions shown in Table 2 and Table 3 was applied to the test material.

Here, a temperature rising pattern at the time of annealing from 600° C. to Ac1 in which, after heating from 600° C. to T1(° C.) (here, 600° C.<T1<Ac1) in a predetermined temperature rising rate, T1 was retained for predetermined time and then the samples were heated from T1 to Ac1 in a predetermined temperature rising rate, was applied to Steel Nos. 1-32 and 35.

On the other hand, a temperature rising pattern at the time of annealing from 600° C. to Ac1 in which, after heating from 600° C. to T1(° C.) (here, 600° C.<T1<Ac1) in a predetermined temperature rising rate, the samples were immediately heated from T1 to Ac1 in a predetermined temperature rising rate without retaining temperature at T1° C., was applied to Steel Nos. 33, 34 and 36.

Ac1 and Ac3 in Table 1 were previously measured by way of experiment. As a specific measuring method thereof, a sample having a diameter of 8 mm and a length of 12 mm was continuously heated at 5° C./s in a heat treatment simulator to measure an expansion curve (relation between temperature and expansion coefficient). Temperatures at inflection points of the expansion curve were determined as Ac1 and Ac3.

TABLE 1

| Steel | Composition (mass %) | | | | | | | | | | | | | Ac1 | Ac3 | (8 × Ac1 + 2 × Ac3)/10 |
|---|---|---|---|---|---|---|---|---|---|---|---|---|---|---|---|---|
| type | C | Si | Mn | P | S | N | Al | Cr | Mo | Cu | Ni | Ca | Mg | (° C.) | (° C.) | (° C.) |
| A | 0.16 | 1.20 | 2.00 | 0.001 | 0.002 | 0.004 | 0.031 | — | — | — | — | 0.0010 | — | 737 | 882 | 766 |
| B | 0.15 | 1.24 | 2.07 | 0.001 | 0.000 | 0.004 | 0.030 | — | — | — | — | — | — | 737 | 887 | 767 |
| C* | 0.15 | 1.22 | 2.00 | 0.001 | 0.012* | 0.004 | 0.030 | — | — | — | — | — | — | 737 | 886 | 767 |
| D* | 0.01* | 1.25 | 2.07 | 0.001 | 0.002 | 0.004 | 0.031 | — | — | — | — | 0.0010 | — | 737 | 946 | 779 |
| E | 0.26 | 1.23 | 2.09 | 0.001 | 0.002 | 0.004 | 0.031 | — | — | — | — | 0.0010 | — | 736 | 861 | 761 |
| F* | 0.41* | 1.21 | 2.01 | 0.001 | 0.002 | 0.004 | 0.030 | — | — | — | — | 0.0010 | — | 737 | 834 | 756 |
| G | 0.15 | 0.10 | 2.04 | 0.001 | 0.002 | 0.004 | 0.031 | — | — | — | — | 0.0010 | — | 704 | 836 | 730 |
| H | 0.15 | 1.85 | 2.04 | 0.001 | 0.002 | 0.004 | 0.030 | — | — | — | — | 0.0010 | — | 755 | 914 | 787 |
| I* | 0.16 | 3.14* | 2.02 | 0.001 | 0.002 | 0.004 | 0.031 | — | — | — | — | 0.0010 | — | 793 | 969 | 828 |
| J* | 0.16 | 1.22 | 0.05* | 0.001 | 0.002 | 0.004 | 0.030 | — | — | — | — | 0.0010 | — | 758 | 883 | 783 |
| K | 0.16 | 1.21 | 1.26 | 0.001 | 0.002 | 0.004 | 0.031 | — | — | — | — | 0.0010 | — | 745 | 883 | 772 |
| L | 0.15 | 1.21 | 3.11 | 0.001 | 0.002 | 0.004 | 0.031 | — | — | — | — | 0.0010 | — | 725 | 885 | 757 |
| M* | 0.15 | 1.25 | 6.19* | 0.001 | 0.002 | 0.004 | 0.031 | — | — | — | — | 0.0010 | — | 693 | 887 | 732 |
| N | 0.15 | 1.24 | 2.02 | 0.001 | 0.002 | 0.004 | 0.031 | 0.50 | — | — | — | 0.0010 | — | 746 | 887 | 774 |
| O | 0.15 | 1.25 | 2.08 | 0.001 | 0.002 | 0.004 | 0.030 | — | 0.20 | — | — | 0.0010 | — | 737 | 894 | 768 |
| P | 0.15 | 1.23 | 2.07 | 0.001 | 0.002 | 0.004 | 0.031 | — | — | 0.40 | — | 0.0010 | — | 737 | 886 | 767 |
| Q | 0.16 | 1.23 | 2.06 | 0.001 | 0.002 | 0.004 | 0.031 | — | — | — | 0.50 | 0.0010 | — | 728 | 876 | 758 |
| R | 0.16 | 1.22 | 2.03 | 0.001 | 0.002 | 0.004 | 0.030 | — | — | — | — | — | 0.0010 | 737 | 883 | 766 |

*Out of the scope of the present invention

TABLE 2

| | | Annealing conditions | | | | | | | | |
|---|---|---|---|---|---|---|---|---|---|---|
| Steel No. | Steel type | Staying time in 600 - Ac1 ° C. (s) | Heating rate in 600° C. - T1 (° C./s) | T1 (° C.) | Retention time at T1 (s) | Heating rate in T1-Ac1 (° C./s) | Recrystallization ratio X (—) | Radius of cementite grain r (μm) | Heating temperature (° C.) | Retention time (s) |
| 1 | A | 205 | 1.0 | 680 | 68 | 1.0 | 0.858 | 0.201 b | 900 | 120 |
| 2 | A | 205 | 1.0 | 680 | 68 | 1.0 | 0.858 | 0.201 b | 780 | 120 |
| 3 | A | 109 a | 3.0 | 680 | 59 | 3.0 | 0.700 b | 0.173 | 780 | 120 |
| 4 | A | 205 | 1.0 | 680 | 68 | 1.0 | 0.858 | 0.201 b | 780 | 120 |
| 5 | A | 205 | 1.0 | 680 | 68 | 1.0 | 0.858 | 0.201 b | 900 | 120 |
| 6 | A | 205 | 1.0 | 680 | 68 | 1.0 | 0.858 | 0.201 b | 750 a | 120 |
| 7 | A | 205 | 1.0 | 680 | 68 | 1.0 | 0.858 | 0.201 b | 780 | 120 |
| 8 | A | 205 | 1.0 | 680 | 68 | 1.0 | 0.858 | 0.201 b | 780 | 120 |
| 9 | A | 205 | 1.0 | 680 | 68 | 1.0 | 0.858 | 0.201 b | 780 | 120 |
| 10 | A | 205 | 1.0 | 680 | 68 | 1.0 | 0.858 | 0.201 b | 780 | 120 |
| 11 | B | 205 | 1.0 | 680 | 68 | 1.0 | 0.858 | 0.201 b | 780 | 120 |
| 12 | C* | 206 | 1.0 | 680 | 69 | 1.0 | 0.858 | 0.201 b | 780 | 120 |
| 13 | D* | 206 | 1.0 | 680 | 69 | 1.0 | 0.858 | 0.201 b | 820 | 120 |
| 14 | E | 205 | 1.0 | 680 | 69 | 1.0 | 0.864 | 0.201 b | 780 | 120 |
| 15 | F* | 205 | 1.0 | 680 | 68 | 1.0 | 0.858 | 0.201 b | 780 | 120 |
| 16 | G | 156 | 3.0 | 700 | 120 | 3.0 | 0.836 | 0.194 b | 770 | 120 |
| 17 | H | 233 | 1.0 | 680 | 78 | 1.0 | 0.963 | 0.216 b | 800 | 120 |
| 18 | H | 233 | 1.0 | 680 | 78 | 1.0 | 0.963 | 0.216 b | 800 | 120 |
| 19 | H | 233 | 1.0 | 680 | 78 | 1.0 | 0.963 | 0.216 b | 800 | 120 |
| 20 | H | 233 | 1.0 | 680 | 78 | 1.0 | 0.963 | 0.216 b | 820 | 120 |

TABLE 2-continued

| | Annealing conditions | | | | Tempering conditions | | | |
|---|---|---|---|---|---|---|---|---|
| Steel No. | First cooling rate (° C./s) | First cooling finish temperature (° C.) | Second cooling rate (° C./s) | Second cooling finish temperature (° C./s) | Heating rate (° C./s) | Heating temperature (° C.) | Retention time (s) | Cooling rate (° C./s) |
| 1 | 6 | 620 | 200 | 100 | 20 | 510 | 3 | 20 |
| 2 | — | 780 | 200 | 100 | 20 | 510 | 3 | 20 |
| 3 | — | 780 | 200 | 100 | 20 | 510 | 3 | 20 |
| 4 | — | 780 | 200 | 100 | 20 | 410 a | 3 | 20 |
| 5 | 5 | 680 | 200 | 100 | 20 | 510 | 3 | 20 |
| 6 | — | 750 | 200 | 100 | 20 | 510 | 3 | 20 |
| 7 | 5 | 600 | 200 | 100 | 20 | 510 | 3 | 20 |
| 8 | — | 780 | 200 | 100 | 20 | 680 a | 3 | 20 |
| 9 | — | 780 | 200 | 100 | 5 a | 510 | 3 | 20 |
| 10 | — | 780 | 200 | 100 | 20 | 460 | 320 a | 20 |
| 11 | — | 780 | 200 | 100 | 20 | 510 | 3 | 20 |
| 12 | — | 780 | 200 | 100 | 20 | 510 | 3 | 20 |
| 13 | — | 820 | 200 | 100 | 20 | 510 | 3 | 20 |
| 14 | — | 780 | 200 | 100 | 20 | 526 | 3 | 20 |
| 15 | — | 780 | 200 | 100 | 20 | 550 | 3 | 20 |
| 16 | — | 770 | 200 | 100 | 20 | 510 | 3 | 20 |
| 17 | — | 800 | 200 | 100 | 20 | 530 | 3 | 20 |
| 18 | 10 | 580 | 200 | 100 | 20 | 530 | 3 | 20 |
| 19 | — | 800 | 200 | 100 | 20 | 530 | 3 | 20 |
| 20 | — | 820 | 200 | 100 | 20 | 515 | 3 | 20 |

*Out of the scope of the present invention, a: Out of recommended range of preferable manufacturing method (Method 1), b: Out of recommended range of preferable manufacturing method (Method 2)

TABLE 3

| | | Annealing conditions | | | | | | | | |
|---|---|---|---|---|---|---|---|---|---|---|
| Steel No. | Steel type | Staying time in 600 - Ac1 ° C. (s) | Heating rate in 600° C. - T1 (° C./s) | T1 (° C.) | Retention time at T1 (s) | Heating rate in T1-Ac1 (° C./s) | Recrystallization ratio X (—) | Radius of cementite grain r (μm) | Heating temperature (° C.) | Retention time (s) |
| 21 | H | 233 | 1.0 | 680 | 78 | 1.0 | 0.963 | 0.216 b | 800 | 120 |
| 22 | I* | 289 | 1.0 | 680 | 96 | 1.0 | 0.999 | 0.239 b | 800 a | 120 |
| 23 | J* | 237 | 1.0 | 680 | 79 | 1.0 | 0.918 | 0.216 b | 780 | 120 |
| 24 | K | 217 | 1.0 | 680 | 72 | 1.0 | 0.906 | 0.205 b | 780 | 120 |
| 25 | L | 187 | 1.0 | 680 | 52 | 1.0 | 0.870 | 0.202 b | 780 | 120 |
| 26 | M* | 140 | 3.0 | 700 | 135 | 3.0 | 0.722 b | 0.185 | 780 | 120 |
| 27 | N | 219 | 1.0 | 680 | 73 | 1.0 | 0.911 | 0.206 b | 780 | 120 |
| 28 | O | 206 | 1.0 | 680 | 69 | 1.0 | 0.858 | 0.201 b | 780 | 120 |
| 29 | P | 205 | 1.0 | 680 | 68 | 1.0 | 0.858 | 0.201 b | 780 | 120 |
| 30 | Q | 192 | 3.0 | 700 | 153 | 3.0 | 0.881 | 0.207 b | 780 | 120 |
| 31 | R | 205 | 1.0 | 680 | 68 | 1.0 | 0.858 | 0.201 b | 780 | 120 |
| 32 | A | 107 a | 5.0 | 720 | 80 | 5.0 | 0.924 | 0.186 | 780 | 120 |
| 33 | A | 57.5 a | 5.0 | 720 | — | 0.5 | 0.856 | 0.161 | 780 | 120 |
| 34 | A | 274 | 0.5 | — | — | 0.5 | 0.927 | 0.216 b | 780 | 120 |
| 35 | H | 111 a | 5.0 | 720 | 80 | 5.0 | 0.937 | 0.188 | 800 | 120 |
| 36 | H | 74 a | 5.0 | 720 | — | 0.5 | 0.934 | 0.172 | 800 | 120 |

| | Annealing conditions | | | | Tempering conditions | | | |
|---|---|---|---|---|---|---|---|---|
| Steel No. | First cooling rate (° C./s) | First cooling finish temperature (° C.) | Second cooling rate (° C./s) | Second cooling finish temperature (° C./s) | Heating rate (° C./s) | Heating temperature (° C.) | Retention time (s) | Cooling rate (° C./s) |
| 21 | — | 800 | 200 | 100 | 20 | 530 | 30 | 20 |
| 22 | — | 800 | 200 | 100 | 20 | 570 | 3 | 20 |
| 23 | — | 780 | 200 | 100 | 20 | 510 | 3 | 20 |
| 24 | — | 780 | 200 | 100 | 20 | 510 | 3 | 20 |
| 25 | — | 780 | 200 | 100 | 20 | 510 | 3 | 20 |
| 26 | — | 780 | 200 | 100 | 20 | 510 | 3 | 20 |
| 27 | — | 780 | 200 | 100 | 20 | 480 | 3 | 20 |
| 28 | — | 780 | 200 | 100 | 20 | 480 | 3 | 20 |
| 29 | — | 780 | 200 | 100 | 20 | 510 | 3 | 20 |
| 30 | — | 780 | 200 | 100 | 20 | 510 | 3 | 20 |

TABLE 3-continued

| | | | | | | | | |
|---|---|---|---|---|---|---|---|---|
| 31 | — | 780 | 200 | 100 | 20 | 510 | 3 | 20 |
| 32 | — | 780 | 200 | 100 | 20 | 510 | 3 | 20 |
| 33 | — | 780 | 200 | 100 | 20 | 510 | 3 | 20 |
| 34 | — | 800 | 200 | 100 | 20 | 510 | 3 | 20 |
| 35 | — | 800 | 200 | 100 | 20 | 530 | 3 | 20 |
| 36 | — | 800 | 200 | 100 | 20 | 530 | 3 | 20 |

*Out of the scope of the present invention,
a: Out of recommended range of preferable manufacturing method (Method 1),
b: Out of recommended range of preferable manufacturing method (Method 2)

For each steel sheet after the heat treatment, area ratios of each phase, KAM values, sizes of cementite grains and their existence numbers and existence forms of ferrite were measured by the measuring methods described in the section of [BEST MODES FOR CARRYING OUT THE INVENTION] described above.

For each steel sheet described above, tensile strength TS, elongation El and stretch flangeability μ were measured. For tensile strength TS and elongation El, No. 5 test specimens described in JIS Z2201 were prepared in a manner that a rolling direction and a perpendicular direction are determined as major axis, and measured according to JIS Z 2241. For stretch flangeability λ, the hole expansion test was performed to measure hole expansion ratio according to The Japan Iron and Steel Federation Standard JFST 1001, and this was defined as stretch flangeability.

Measured results are shown in Table 4 and Table 5.

As shown in these Tables, all of Steel Nos. 1, 2, 7, 11, 14, 16-21, 24, 25 and 27-36, which are examples of the present invention, satisfied tensile strength TS of 780 MPa or more, TS×El of 14000 MPa·% or more and TS×El×λ of 800000 MPa·%·% or more, and a high-strength cold-rolled steel sheet which satisfied required level described in above [BACKGROUND ART] and had excellent balance between elongation and stretch flangeability was obtained.

Among the examples of the present invention, particularly, the temperature rising pattern at the time of annealing of Steel Nos. 32, 33, 35 and 36 satisfied both of X≥0.8 and r≤0.19, which are recommended conditions in [Preferable manufacturing conditions of steel sheet of the present invention (Method 2)] described above. As a result, high-strength cold-rolled steel sheet which satisfied TS×El×λ of 1500000 MPa·%·% or more far exceeding the required level, and had excellent balance of mechanical properties was obtained.

However, among the examples of the present invention described above, although temperature rising pattern at the time of annealing of Steel No. 34 satisfies X≥0.8, r exceeds 0.19. Consequently, λ is slightly low, and thereby TS×El×λ does not reach to 1500000 MPa·%·%.

On the contrary, in Steel Nos. 3-6, 8-10, 12, 13, 15, 22, 23 and 26, at least one of TS×El and TS×El×λ is inferior.

For example, Steel Nos. 3-6 and 8-10 are out of the recommended range of annealing conditions or tempering conditions, and thereby these examples do not satisfy at least one of specified requirements for structures of the present invention, and thereby at least one of TS×El and TS×El×λ is inferior.

Since C content of Steel No. 13 is too low, the area ratio of ferrite becomes too high, and thereby TS×El is inferior.

On the other hand, since C content of Steel No. 15 is too high, too many rough and large cementite grains are generated, and thereby TS×El×λ is inferior.

Since Mn content of Steel No. 23 is too low, suppression effect for formation of rough and large cementite at the time of tempering and deformation ability improvement effect of the hard phase is not sufficiently exerted, and thereby both of elongation and stretch flangeability cannot be satisfied and TS×El×λ is inferior.

Since Mn content of Steel No. 26 is too high, recrystallization cannot be caused because reverse transformation temperature becomes too low, and thereby balance between strength and elongation cannot be ensured and both of TS×El and TS×El×λ are inferior.

TABLE 4

| | | Structure | | | | | | | Mechanical properties | | | | |
|---|---|---|---|---|---|---|---|---|---|---|---|---|---|
| | | Area ratio (%) | | | | | Existence | Density of θ having | | | | | |
| Steel No. | Steel type | α | Hard phase | Other structure | $X_{KAM\leq0.4^a}/V_\alpha$ (—) | $X_{KAM=0.6\text{-}0.8^a}$ (%) | form of α (—) | 0.1 μm or more (number/μm²) | TS (MPa) | El (%) | λ (%) | TS × El (MPa · %) | TS × El × λ (MPa · % · %) |
| 1 | A | 62 | 38 | 0 | 0.98 | 15 | 0.32 | 0.6 | 1020 | 13.8 | 68 | 14076 | 957168 |
| 2 | A | 62 | 38 | 0 | 0.93 | 14 | 0.10 | 0.8 | 1008 | 16.1 | 75 | 16229 | 1217160 |
| 3 | A | 60 | 40 | 0 | 0.67* | 15 | 0.15 | 0.7 | 1045 | 11.8 | 72 | 12331* | 887832 |
| 4 | A | 63 | 37 | 0 | 0.93 | 5* | 0.12 | 0.2 | 1084 | 15.1 | 42 | 16368 | 687473* |
| 5 | A | 5* | 95* | 0 | 0.86 | 18 | 0.00 | 0.7 | 1060 | 11.8 | 110 | 12508* | 1375880 |
| 6 | A | 95* | 5* | 0 | 0.91 | 5* | 0.18 | 0.4 | 850 | 18.5 | 42 | 15725 | 660450* |
| 7 | A | 76 | 24 | 0 | 0.93 | 12 | 0.12 | 0.8 | 880 | 18.2 | 67 | 16016 | 1073072 |
| 8 | A | 60 | 40 | 0 | 0.90 | 14 | 0.10 | 5.1* | 926 | 19.5 | 42 | 18057 | 758394* |
| 9 | A | 60 | 40 | 0 | 0.92 | 14 | 0.08 | 3.4* | 1010 | 16.1 | 45 | 16261 | 731745* |
| 10 | A | 60 | 40 | 0 | 0.90 | 15 | 0.10 | 4.2* | 997 | 17.2 | 38 | 17148 | 651639* |
| 11 | B | 60 | 40 | 0 | 0.92 | 14 | 0.08 | 0.7 | 1012 | 16.0 | 58 | 16192 | 939136 |
| 12 | C* | 60 | 40 | 0 | 0.90 | 15 | 0.10 | 0.9 | 1021 | 15.7 | 43 | 16030 | 689277* |
| 13 | D* | 100* | 0* | 0 | 0.95 | 2* | 0.78 a | 0.0 | 621* | 21.0 | 70 | 13041* | 912870 |
| 14 | E | 50 | 50 | 0 | 0.91 | 18 | 0.05 | 1.2 | 1023 | 17.6 | 61 | 18005 | 1098293 |

TABLE 4-continued

| Steel No. | Steel type | Structure: Area ratio (%) α | Hard phase | Other structure | $X_{KAM \leq 0.4}{}^{a}/V_{\alpha}$ (—) | $X_{KAM-0.6-0.8}{}^{a}$ (%) | Existence form of α (—) | Density of θ having 0.1 μm or more (number/μm²) | Mechanical properties: TS (MPa) | E1 (%) | λ (%) | TS × E1 (MPa · %) | TS × E1 × λ (MPa · % · %) |
|---|---|---|---|---|---|---|---|---|---|---|---|---|---|
| 15 | F* | 32 | 68 | 0 | 0.88 | 19 | 0.03 | 4.6* | 1055 | 15.1 | 32 | 15931 | 509776* |
| 16 | G | 40 | 60 | 0 | 0.93 | 15 | 0.06 | 1.2 | 850 | 17.2 | 72 | 14620 | 1052640 |
| 17 | H | 65 | 35 | 0 | 0.90 | 15 | 0.10 | 0.4 | 1032 | 16.3 | 76 | 16822 | 1278442 |
| 18 | H | 70 | 30 | 0 | 0.92 | 13 | 0.12 | 0.4 | 1001 | 17.8 | 73 | 17818 | 1300699 |
| 19 | H | 63 | 37 | 0 | 1.00 | 11 | 0.08 | 0.3 | 1025 | 17.2 | 70 | 17630 | 1234100 |
| 20 | H | 45 | 55 | 0 | 0.92 | 11 | 0.08 | 0.3 | 1211 | 14.0 | 65 | 16954 | 1102010 |

*Out of the scope of the present invention,
a: Out of recommended range,
α: ferrite, Other structure: retained austenite + martensite,
θ: cementite

TABLE 5

| Steel No. | Steel type | Structure: Area ratio (%) α | Hard phase | Other structure | $X_{KAM \leq 0.4}{}^{a}/V_{\alpha}$ (—) | $X_{KAM-0.6-0.8}{}^{a}$ (%) | Existence form of α (—) | Density of θ having 0.1 μm or more (number/μm²) | Mechanical properties: TS (MPa) | E1 (%) | λ (%) | TS × E1 (MPa · %) | TS × E1 × λ (MPa · % · %) |
|---|---|---|---|---|---|---|---|---|---|---|---|---|---|
| 21 | H | 58 | 42 | 0 | 0.92 | 11 | 0.08 | 0.3 | 1033 | 15.4 | 62 | 15908 | 986308 |
| 22 | I* | 96* | 4* | 0 | 0.92 | 11 | 0.08 | 0.3 | 1034 | 18.3 | 32 | 18922 | 605510* |
| 23 | J* | 75 | 25 | 0 | 0.95 | 16 | 0.05 | 0.9 | 851 | 15.4 | 43 | 13105 | 563532* |
| 24 | K | 70 | 30 | 0 | 0.90 | 11 | 0.12 | 0.8 | 1021 | 16.3 | 75 | 16642 | 1248173 |
| 25 | L | 70 | 30 | 0 | 0.92 | 14 | 0.10 | 0.8 | 1031 | 16.3 | 75 | 16805 | 1260398 |
| 26 | M* | 30 | 70 | 0 | 0.51* | 12 | 0.12 | 1.0 | 1187 | 8.9 | 71 | 10564* | 750065* |
| 27 | N | 47 | 53 | 0 | 0.92 | 17 | 0.10 | 0.6 | 1185 | 15.1 | 72 | 17894 | 1288332 |
| 28 | O | 55 | 45 | 0 | 0.93 | 11 | 0.14 | 0.3 | 1205 | 14.6 | 65 | 17593 | 1143545 |
| 29 | P | 58 | 42 | 0 | 0.90 | 13 | 0.10 | 0.7 | 1140 | 17.2 | 68 | 19608 | 1333344 |
| 30 | Q | 60 | 40 | 0 | 0.95 | 12 | 0.11 | 0.8 | 1196 | 14.6 | 81 | 17462 | 1414390 |
| 31 | R | 64 | 36 | 0 | 0.97 | 16 | 0.12 | 0.7 | 982 | 17.1 | 73 | 16792 | 1225831 |
| 32 | A | 64 | 36 | 0 | 0.97 | 16 | 0.12 | 0.08 | 1000 | 17.6 | 90 | 17600 | 1584000 |
| 33 | A | 64 | 36 | 0 | 0.92 | 15 | 0.10 | 0.02 | 1020 | 16.4 | 98 | 16728 | 1639344 |
| 34 | A | 65 | 35 | 0 | 0.90 | 15 | 0.12 | 0.30 | 1005 | 17.3 | 70 | 17387 | 1217055 |
| 35 | H | 65 | 35 | 0 | 0.92 | 15 | 0.10 | 0.09 | 1002 | 17.6 | 93 | 17635 | 1640074 |
| 36 | H | 65 | 35 | 0 | 0.91 | 16 | 0.14 | 0.04 | 992 | 18.1 | 98 | 17955 | 1759610 |

*Out of the scope of the present invention,
a: Out of recommended range,
α: ferrite,
Other structure: retained austenite + martensite,
θ: cementite

Example 2

Steel having compositions shown in Table 6 described below was prepared by melting, and ingot having a thickness of 120 mm was prepared. A thickness of the ingot was reduced to 25 mm by hot rolling, and reduced again to 3.2 mm by hot rolling. A test material was prepared in a manner that this steel sheet was washed with acid and its thickness was reduced to 1.6 mm by cold rolling. Heat treatment under the conditions shown in Table 7 and Table 8 was applied to the test material.

Here, a temperature rising pattern at the time of annealing from 600° C. to Ac1 in which, after heating from 600° C. to T1(° C.) (here, 600° C.<T1<Ac1) in a predetermined temperature rising rate, T1 was retained for predetermined time and then the samples were heated from T1 to Ac1 in a predetermined temperature rising rate, was applied to Steel Nos. 1-35.

On the other hand, a temperature rising pattern at the time of annealing from 600° C. to Ac1 in which, after heating from 600° C. to T1(° C.) (here, 600° C.<T1<Ac1) in a predetermined temperature rising rate, the samples were immediately heated from T1 to Ac1 in a predetermined temperature rising rate without retaining temperature at T1° C., was applied to Steel No. 36.

Ac1 and Ac3 in Table 6 were previously measured by way of experiment. As a specific measuring method thereof, a sample having a diameter of 8 mm and a length of 12 mm was continuously heated at 5° C./s in a heat treatment simulator to measure an expansion curve (relation between temperature and expansion coefficient). Temperatures at inflection points of the expansion curve are determined as Ac1 and Ac3.

TABLE 6

| Steel type | Composition (mass %) C | Si | Mn | P | S | N | Al | Nb | Ti | V | (Nb/96 + Ti/51 + V/48) × 48 | Others | Ac1 (° C.) | Ac3 (° C.) | (8 × Ac1 + 2 × Ac3)/10 (° C.) |
|---|---|---|---|---|---|---|---|---|---|---|---|---|---|---|---|
| A | 0.16 | 1.20 | 2.00 | 0.001 | 0.002 | 0.004 | 0.031 | — | 0.04 | — | 0.04 | Ca: 0.0010 | 737 | 882 | 766 |
| B | 0.15 | 1.24 | 2.07 | 0.001 | 0.002 | 0.004 | 0.030 | — | 0.04 | — | 0.04 | — | 737 | 887 | 767 |
| C | 0.15 | 1.23 | 2.00 | 0.001 | 0.002 | 0.004 | 0.030 | — | — | 0.05 | 0.05 | — | 737 | 886 | 767 |
| D | 0.15 | 1.25 | 2.07 | 0.001 | 0.002 | 0.004 | 0.031 | 0.07 | — | — | 0.04 | Ca: 0.0010 | 737 | 887 | 767 |
| E | 0.15 | 1.23 | 2.09 | 0.001 | 0.002 | 0.004 | 0.031 | — | 0.02 | 0.03 | 0.05 | Ca: 0.0010 | 736 | 886 | 766 |
| F | 0.15 | 1.21 | 2.01 | 0.001 | 0.002 | 0.004 | 0.030 | — | 0.08 | — | 0.08 | Ca: 0.0010 | 737 | 885 | 766 |
| G* | 0.15 | 1.18 | 2.04 | 0.001 | 0.002 | 0.004 | 0.031 | 0.18 | — | 0.15 | 0.24* | Ca: 0.0010 | 736 | 884 | 765 |
| H* | 0.01* | 1.21 | 2.04 | 0.001 | 0.002 | 0.004 | 0.030 | — | 0.05 | — | 0.05 | Ca: 0.0010 | 736 | 944 | 778 |
| I | 0.08 | 1.23 | 2.02 | 0.001 | 0.002 | 0.004 | 0.031 | — | 0.05 | — | 0.05 | Ca: 0.0010 | 737 | 908 | 771 |
| J | 0.22 | 1.22 | 1.99 | 0.001 | 0.002 | 0.004 | 0.030 | — | 0.05 | — | 0.05 | Ca: 0.0010 | 737 | 869 | 764 |
| K* | 0.41* | 1.21 | 2.00 | 0.001 | 0.002 | 0.004 | 0.031 | — | 0.05 | — | 0.05 | Ca: 0.0010 | 737 | 834 | 756 |
| L | 0.15 | 0.10 | 1.95 | 0.001 | 0.002 | 0.004 | 0.031 | — | 0.05 | — | 0.05 | Ca: 0.0010 | 705 | 836 | 731 |
| M | 0.15 | 1.94 | 2.02 | 0.001 | 0.002 | 0.004 | 0.031 | — | 0.05 | — | 0.05 | Ca: 0.0010 | 758 | 918 | 790 |
| N* | 0.15 | 3.14* | 2.02 | 0.001 | 0.002 | 0.004 | 0.031 | — | 0.05 | — | 0.05 | Ca: 0.0010 | 793 | 972 | 829 |
| O* | 0.15 | 1.25 | 0.05* | 0.001 | 0.002 | 0.004 | 0.030 | — | 0.05 | — | 0.05 | Ca: 0.0010 | 759 | 887 | 785 |
| P | 0.15 | 1.23 | 1.26 | 0.001 | 0.002 | 0.004 | 0.031 | — | 0.05 | — | 0.05 | Ca: 0.0010 | 745 | 886 | 774 |
| Q | 0.15 | 1.23 | 3.11 | 0.001 | 0.002 | 0.004 | 0.031 | — | 0.05 | — | 0.05 | Ca: 0.0010 | 726 | 886 | 758 |
| R* | 0.15 | 1.22 | 6.10* | 0.001 | 0.002 | 0.004 | 0.030 | — | 0.05 | — | 0.05 | Ca: 0.0010 | 693 | 886 | 732 |
| S* | 0.15 | 1.22 | 2.03 | 0.001 | 0.002 | 0.004 | 0.030 | — | — | — | 0.00* | Ca: 0.0010 | 737 | 886 | 767 |
| T | 0.15 | 1.22 | 2.03 | 0.001 | 0.002 | 0.004 | 0.030 | — | 0.05 | — | 0.05 | Cr: 0.50, Ca: 0.0010 | 745 | 886 | 773 |
| U | 0.15 | 1.22 | 2.03 | 0.001 | 0.002 | 0.004 | 0.030 | — | 0.05 | — | 0.05 | Mo: 0.20, Ca: 0.0010 | 737 | 892 | 768 |
| V | 0.15 | 1.22 | 2.03 | 0.001 | 0.002 | 0.004 | 0.030 | — | 0.05 | — | 0.05 | Cu: 0.40, Ca: 0.0010 | 737 | 886 | 767 |
| W | 0.15 | 1.22 | 2.03 | 0.001 | 0.002 | 0.004 | 0.030 | — | 0.05 | — | 0.05 | Ni: 0.50, Ca: 0.0010 | 728 | 878 | 758 |
| X | 0.15 | 1.22 | 2.03 | 0.001 | 0.002 | 0.004 | 0.030 | — | 0.05 | — | 0.05 | Mg: 0.0010 | 737 | 886 | 767 |

*Out of the scope of the present invention

TABLE 7

| Steel No. | Steel type | Hot rolling conditions: Finish temperature of finishing (° C.) | Cooling time down to 550° C. (s) | Take-up temperature (° C.) | Annealing conditions: Staying time in 600 - Ac1 ° C. (s) | Heating rate in 600° C. - T1 (° C./s) | T1 (° C.) | Retention time at T1 (s) | Heating rate in T1-Ac1 (° C./s) | Recrystallization ratio X (—) | Radius of cementite grain r (μm) |
|---|---|---|---|---|---|---|---|---|---|---|---|
| 1 | A | 920 | 15 | 500 | 1010 | 1.0 | 700 | 793 | 1.0 | 0.830 | 0.209 b |
| 2 | A | 920 | 15 | 500 | 1010 | 1.0 | 700 | 793 | 1.0 | 0.830 | 0.209 b |
| 3 | A | 850 a | 12 | 500 | 1010 | 3.0 | 700 | 793 | 3.0 | 0.830 | 0.209 b |
| 4 | A | 920 | 37 a | 500 | 1010 | 1.0 | 700 | 793 | 1.0 | 0.830 | 0.209 b |
| 5 | A | 920 | 15 | 600 a | 1010 | 1.0 | 700 | 793 | 1.0 | 0.830 | 0.209 b |
| 6 | A | 920 | 15 | 500 | 237 a | 1.0 | 700 | 100 | 1.0 | 0.499 b | 0.148 |
| 7 | A | 920 | 15 | 500 | 1010 | 1.0 | 700 | 793 | 1.0 | 0.830 | 0.209 b |
| 8 | A | 920 | 15 | 500 | 1010 | 1.0 | 700 | 793 | 1.0 | 0.830 | 0.209 b |
| 9 | A | 920 | 15 | 500 | 1010 | 1.0 | 700 | 793 | 1.0 | 0.830 | 0.209 b |
| 10 | A | 920 | 15 | 500 | 1010 | 1.0 | 700 | 793 | 1.0 | 0.830 | 0.209 b |
| 11 | A | 920 | 15 | 500 | 1010 | 1.0 | 700 | 793 | 1.0 | 0.830 | 0.209 b |
| 12 | A | 920 | 15 | 500 | 1010 | 1.0 | 700 | 793 | 1.0 | 0.830 | 0.209 b |
| 13 | B | 920 | 15 | 500 | 1011 | 1.0 | 700 | 794 | 1.0 | 0.830 | 0.209 b |
| 14 | C | 920 | 15 | 500 | 1012 | 1.0 | 700 | 795 | 1.0 | 0.830 | 0.209 b |
| 15 | D | 920 | 15 | 500 | 1012 | 1.0 | 700 | 795 | 1.0 | 0.830 | 0.209 b |
| 16 | E | 920 | 15 | 500 | 1009 | 1.0 | 700 | 793 | 1.0 | 0.829 | 0.209 b |
| 17 | F | 920 | 15 | 500 | 1010 | 1.0 | 700 | 794 | 1.0 | 0.830 | 0.209 b |
| 18 | G* | 920 | 15 | 500 | 1007 | 1.0 | 700 | 791 | 1.0 | 0.829 | 0.209 b |
| 19 | H* | 920 | 15 | 500 | 1009 | 1.0 | 700 | 793 | 1.0 | 0.829 | 0.209 b |

| Steel No. | Annealing conditions: Heating temperature (° C.) | Retention time (s) | First cooling rate (° C./s) | First cooling finish temperature (° C.) | Second cooling rate (° C./s) | Second cooling finish temperature (° C./s) | Tempering conditions: Heating rate (° C./s) | Heating temperature (° C.) | Retention time (s) | Cooling rate (° C./s) |
|---|---|---|---|---|---|---|---|---|---|---|
| 1 | 900 | 120 | 6 | 620 | 200 | 100 | 20 | 510 | 3 | 20 |
| 2 | 780 | 120 | — | 780 | 200 | 100 | 20 | 510 | 3 | 20 |
| 3 | 780 | 120 | — | 780 | 200 | 100 | 20 | 510 | 3 | 20 |
| 4 | 780 | 120 | — | 780 | 200 | 100 | 20 | 510 | 3 | 20 |
| 5 | 780 | 120 | — | 780 | 200 | 100 | 20 | 510 | 3 | 20 |
| 6 | 780 | 120 | — | 780 | 200 | 100 | 20 | 510 | 3 | 20 |
| 7 | 780 | 120 | — | 780 | 200 | 100 | 20 | 410 a | 3 | 20 |

TABLE 7-continued

| | | | | | | | | | | |
|---|---|---|---|---|---|---|---|---|---|---|
| 8 | 900 | 120 | 5 | 680 | 200 | 100 | 20 | 510 | 3 | 20 |
| 9 | 750 a | 120 | — | 750 | 200 | 100 | 20 | 510 | 3 | 20 |
| 10 | 780 | 120 | 5 | 600 | 200 | 100 | 20 | 510 | 3 | 20 |
| 11 | 780 | 120 | — | 780 | 200 | 100 | 20 | 680 a | 3 | 20 |
| 12 | 780 | 120 | — | 780 | 200 | 100 | 20 | 460 a | 320 a | 20 |
| 13 | 780 | 120 | — | 780 | 200 | 100 | 20 | 510 | 3 | 20 |
| 14 | 780 | 120 | — | 780 | 200 | 100 | 20 | 510 | 3 | 20 |
| 15 | 780 | 120 | — | 780 | 200 | 100 | 20 | 510 | 3 | 20 |
| 16 | 780 | 120 | — | 780 | 200 | 100 | 20 | 510 | 3 | 20 |
| 17 | 780 | 120 | — | 780 | 200 | 100 | 20 | 510 | 3 | 20 |
| 18 | 780 | 120 | — | 780 | 200 | 100 | 20 | 510 | 3 | 20 |
| 19 | 790 | 120 | — | 790 | 200 | 100 | 20 | 510 | 3 | 20 |

*Out of the scope of the present invention,
a: Out of recommended range of preferable manufacturing method (Method 3)
b: Out of recommended range of preferable manufacturing method (Method 4)

TABLE 8

| | | Hot rolling conditions | | | Annealing conditions | | | | | | |
|---|---|---|---|---|---|---|---|---|---|---|---|
| Steel No. | Steel type | Finish temperature of finishing (° C.) | Cooling time down to 550° C. (s) | Take-up temperature (° C.) | Staying time in 600 - Ac1 ° C. (s) | Heating rate in 600° C. - T1 (° C./s) | T1 (° C.) | Retention time at T1 (s) | Heating rate in T1-Ac1 (° C./s) | Recrystallization ratio X (—) | Radius of cementite grain r (μm) |
| 20 | I | 920 | 15 | 500 | 1012 | 1.0 | 700 | 795 | 1.0 | 0.830 | 0.209 b |
| 21 | K* | 920 | 15 | 500 | 1010 | 1.0 | 700 | 795 | 1.0 | 0.830 | 0.209 b |
| 22 | L | 920 | 15 | 500 | 915 | 1.0 | 700 | 705 | 1.0 | 0.774 b | 0.202 b |
| 23 | M | 920 | 15 | 500 | 1074 | 1.0 | 700 | 919 | 1.0 | 0.848 | 0.212 b |
| 24 | N* | 920 | 15 | 500 | 1178 | 1.0 | 700 | 985 | 1.0 | 0.945 | 0.220 b |
| 25 | O* | 920 | 15 | 500 | 1077 | 1.0 | 700 | 918 | 1.0 | 0.850 | 0.212 b |
| 26 | P | 920 | 15 | 500 | 1036 | 1.0 | 700 | 891 | 1.0 | 0.821 | 0.209 b |
| 27 | Q | 920 | 15 | 500 | 977 | 1.0 | 700 | 851 | 1.0 | 0.793 b | 0.206 b |
| 28 | R* | 920 | 15 | 500 | 880 | 1.0 | 690 | 787 | 1.0 | 0.662 b | 0.195 b |
| 29 | S* | 920 | 15 | 500 | 1010 | 1.0 | 700 | 873 | 1.0 | 0.808 | 0.208 b |
| 30 | T | 920 | 15 | 500 | 1036 | 1.0 | 700 | 891 | 1.0 | 0.821 | 0.209 b |
| 31 | U | 920 | 15 | 500 | 1010 | 1.0 | 700 | 873 | 1.0 | 0.808 | 0.208 b |
| 32 | V | 920 | 15 | 500 | 1010 | 1.0 | 700 | 873 | 1.0 | 0.808 | 0.208 b |
| 33 | W | 920 | 15 | 500 | 985 | 1.0 | 700 | 857 | 1.0 | 0.786 b | 0.206 b |
| 34 | X | 920 | 15 | 500 | 1010 | 1.0 | 700 | 873 | 1.0 | 0.808 | 0.208 b |
| 35 | A | 920 | 15 | 500 | 427 | 5.0 | 720 | 400 | 5.0 | 0.826 | 0.177 |
| 36 | A | 920 | 15 | 500 | 390 | 5.0 | 700 | — | 0.1 | 0.817 | 0.172 |

| | Annealing conditions | | | | | | Tempering conditions | | | |
|---|---|---|---|---|---|---|---|---|---|---|
| Steel No. | Heating temperature (° C.) | Retention time (s) | First cooling rate (° C./s) | First cooling finish temperature (° C.) | Second cooling rate (° C./s) | Second cooling finish temperature (° C./s) | Heating rate (° C./s) | Heating temperature (° C.) | Retention time (s) | Cooling rate (° C./s) |
| 20 | 790 | 120 | — | 790 | 200 | 100 | 20 | 510 | 3 | 20 |
| 21 | 770 | 120 | — | 770 | 200 | 100 | 20 | 510 | 3 | 20 |
| 22 | 750 | 120 | — | 750 | 200 | 100 | 20 | 510 | 3 | 20 |
| 23 | 810 | 120 | — | 810 | 200 | 100 | 20 | 510 | 3 | 20 |
| 24 | 840 | 120 | — | 840 | 200 | 100 | 20 | 510 | 3 | 20 |
| 25 | 800 | 120 | — | 800 | 200 | 100 | 20 | 510 | 3 | 20 |
| 26 | 790 | 120 | — | 790 | 200 | 100 | 20 | 510 | 3 | 20 |
| 27 | 770 | 120 | — | 770 | 200 | 100 | 20 | 510 | 3 | 20 |
| 28 | 750 | 120 | — | 750 | 200 | 100 | 20 | 510 | 3 | 20 |
| 29 | 780 | 120 | — | 780 | 200 | 100 | 20 | 510 | 3 | 20 |
| 30 | 790 | 120 | — | 790 | 200 | 100 | 20 | 510 | 3 | 20 |
| 31 | 780 | 120 | — | 780 | 200 | 100 | 20 | 510 | 3 | 20 |
| 32 | 780 | 120 | — | 780 | 200 | 100 | 20 | 510 | 3 | 20 |
| 33 | 770 | 120 | — | 770 | 200 | 100 | 20 | 510 | 3 | 20 |
| 34 | 780 | 120 | — | 780 | 200 | 100 | 20 | 510 | 3 | 20 |
| 35 | 780 | 120 | — | 780 | 200 | 100 | 20 | 510 | 3 | 20 |
| 36 | 780 | 120 | — | 780 | 200 | 100 | 20 | 510 | 3 | 20 |

*Out of the scope of the present invention,
a: Out of recommended range of preferable manufacturing method (Method 3),
b: Out of recommended range of preferable manufacturing method (Method 4)

For each steel sheet after the heat treatment, area ratios of each phase, average diameter of ferrite, KAM values, sizes of precipitate and their existence numbers and existence forms of ferrite were measured by the measuring methods described in the section of [BEST MODES FOR CARRYING OUT THE INVENTION] described above.

For each steel sheet described above, tensile strength TS, elongation El and stretch flangeability λ were measured. For tensile strength TS and elongation El, No. 5 test specimens described in JIS Z2201 were prepared in a manner that a rolling direction and a perpendicular direction are determined as major axis, and measured according to JIS Z 2241. For stretch flangeability λ, the hole expansion test was performed to measure hole expansion ratio according to The Japan Iron and Steel Federation Standard JFST 1001, and this was defined as stretch flange ability.

Measured results are shown in Table 9.

As shown in Table 9, all of Steel Nos. 1, 2, 10, 13-17, 20, 22, 23, 26, 27 and 30-36, which are examples of the present invention, satisfied tensile strength TS of 780 MPa or more, Ts×El of 16000 MPa·% or more and TS×El×λ of 1200000 MPa·%·% or more, and a high-strength cold-rolled steel sheet which had excellent balance between elongation and stretch flangeability was obtained.

Among the examples of the present invention, particularly, the temperature rising pattern at the time of annealing of Steel Nos. and 36 satisfied both of X≥0.8 and r≤0.19, which are recommended conditions in [Preferable manufacturing conditions of steel sheet of the present invention (Method 4)] described above. As a result, a high-strength cold-rolled steel sheet which satisfied TS×El×λ of 1800000 MPa·%·% or more far exceeding the required level, and had excellent balance of mechanical properties was obtained.

On the contrary, in Steel Nos. 3-9, 11, 12, 18, 19, 21, 24, 25, 28 and 29, at least one of TS×El and TS×El×λ is inferior.

For example, Steel Nos. 3-9, 11 and 12 are out of the recommended range of annealing conditions or tempering conditions, and thereby these examples do not satisfy at least one of specified requirements for structures of the present invention, and thereby at least one of TS×El and TS×El×λ is inferior.

Since C content of Steel No. 19 is too low, Ts is inferior.

On the other hand, since C content of Steel No. 21 is too high, too many rough and large cementite grains are generated, and thereby TS×El and TS×El×λ are inferior.

Since Mn content of Steel No. 25 is too low, TS is inferior.

Since Mn content of Steel No. 28 is too high, recrystallization cannot be caused because reverse transformation temperature becomes too low, and thereby balance between strength and elongation cannot be ensured and TS×λ is inferior.

Since V the total amount of V converted content of Steel No. 18 is too high, balance between strength and elongation cannot be ensured, stretch flangeability is deteriorated, and thereby TS×El×λ is inferior.

Since V the total amount of V converted content of Steel No. 29 is too low, ferrite grains becomes rough and large. Although Steel No. 29 is acceptable level in the level of Example 1 described above, TS×El and TS×El×λ are slightly inferior to other examples which satisfy even conditions of ferrite grains of 5 μm or lower.

TABLE 9

| | | Structure | | | | | | | | | Mechanical properties | | | | |
|---|---|---|---|---|---|---|---|---|---|---|---|---|---|---|---|
| | | Area ratio (%) | | | Average grain | | | Existence | Precipitate density (number/μm²) | | | | | | |
| Steel No. | Steel type | α | Hard phase | Other structure | size of α (μm) | $X_{KAM\leq0.4^a}/V_\alpha$ (—) | $X_{KAM-0.6\text{-}0.8^a}$ (%) | form of α (—) | ≥0.1 μm θ | ≥20 Nm MX | TS (MPa) | El (%) | λ (%) | TS × El (MPa · %) | TS × El × λ (MPa ·% · %) |
| 1 | A | 62 | 38 | 0 | 4.2 | 0.98 | 13 | 0.32 | 0.6 | 0.69 | 1063 | 15.9 | 74 | 16902 | 1250726 |
| 2 | A | 62 | 38 | 0 | 2.6 | 0.93 | 14 | 0.10 | 0.8 | 0.62 | 1036 | 18.5 | 85 | 19166 | 1629110 |
| 3 | A | 62 | 38 | 0 | 2.6 | 0.93 | 14 | 0.10 | 0.8 | 32.0* | 1011 | 18.5 | 40 | 18704 | 748140* |
| 4 | A | 62 | 38 | 0 | 2.7 | 0.93 | 14 | 0.10 | 0.8 | 42.0* | 1014 | 18.3 | 35 | 18556 | 649467* |
| 5 | A | 62 | 38 | 0 | 3.4 | 0.93 | 14 | 0.10 | 0.8 | 44.0* | 1023 | 18.0 | 41 | 18414 | 754974* |
| 6 | A | 60 | 40 | 0 | 2.8 | 0.67* | 15 | 0.15 | 0.7 | 0.64 | 1062 | 12.2 | 72 | 12956* | 932861 |
| 7 | A | 63 | 37 | 0 | 3.1 | 0.93 | 5* | 0.12 | 0.2 | 0.72 | 1086 | 17.2 | 42 | 18679 | 784326* |
| 8 | A | 5* | 95* | 0 | 3.2 | 0.86 | 18 | 0.00 | 0.7 | 0.77 | 1065 | 12.2 | 110 | 12993* | 1429230 |
| 9 | A | 95* | 5* | 0 | 2.9 | 0.91 | 5* | 0.18 | 0.4 | 0.69 | 860 | 22.1 | 42 | 19006 | 798252* |
| 10 | A | 76 | 24 | 0 | 3.4 | 0.93 | 12 | 0.12 | 0.8 | 0.76 | 889 | 21.9 | 67 | 19469 | 1304430 |
| 11 | A | 60 | 40 | 0 | 3.0 | 0.90 | 14 | 0.10 | 5.1* | 0.65 | 939 | 19.6 | 42 | 18404 | 772985* |
| 12 | A | 60 | 40 | 0 | 2.8 | 0.90 | 4* | 0.10 | 0.9 | 0.55 | 1014 | 18.3 | 38 | 18556 | 705136* |
| 13 | B | 56 | 44 | 0 | 3.1 | 0.93 | 14 | 0.10 | 0.8 | 0.53 | 1032 | 18.2 | 85 | 18782 | 1596504 |
| 14 | C | 64 | 36 | 0 | 3.3 | 0.91 | 14 | 0.10 | 0.8 | 0.55 | 1050 | 18.1 | 80 | 19005 | 1520400 |
| 15 | D | 61 | 39 | 0 | 3.0 | 0.93 | 15 | 0.10 | 0.8 | 0.51 | 1013 | 18.4 | 77 | 18639 | 1435218 |
| 16 | E | 65 | 35 | 0 | 3.0 | 1.01 | 13 | 0.10 | 0.8 | 0.68 | 1001 | 18.0 | 81 | 18018 | 1459458 |
| 17 | F | 58 | 42 | 0 | 3.2 | 0.93 | 14 | 0.10 | 0.8 | 0.76 | 1004 | 18.4 | 74 | 18474 | 1367046 |
| 18 | G* | 51 | 49 | 0 | 3.3 | 0.45* | 12 | 0.10 | 0.8 | 103.6* | 1005 | 18.3 | 24 | 18392 | 441396* |
| 19 | H* | 51 | 49 | 0 | 3.4 | 1.05 | 14 | 0.91a | 0.0 | 0.77 | 642* | 22.4 | 67 | 14381 | 963514 |
| 20 | I | 65 | 35 | 0 | 3.2 | 0.95 | 15 | 0.10 | 0.9 | 0.62 | 855 | 19.4 | 87 | 16587 | 1443069 |
| 21 | K* | 69 | 31 | 0 | 3.0 | 0.43 | 18 | 0.05 | 4.7* | 0.53 | 1352 | 9.2 | 45 | 12438* | 559728* |
| 22 | L | 56 | 44 | 0 | 3.4 | 0.88 | 19 | 0.03 | 1.3 | 0.71 | 931 | 19.6 | 66 | 18248 | 1204342 |
| 23 | M | 55 | 45 | 0 | 2.8 | 0.93 | 15 | 0.06 | 0.2 | 0.56 | 1184 | 15.3 | 78 | 18115 | 1412986 |
| 24 | N* | 67 | 33 | 0 | 3.4 | 1.00 | 15 | 0.10 | 0.8 | 0.54 | 1322 | 3.1 | 9 | 4098* | 36884* |
| 25 | O* | 82* | 18 | 0 | 3.1 | 1.01 | 11 | 0.08 | 0.3 | 0.69 | 740* | 24.0 | 77 | 17760 | 1367520 |
| 26 | P | 53 | 47 | 0 | 2.6 | 0.99 | 16 | 0.05 | 0.9 | 0.78 | 856 | 21.4 | 84 | 18318 | 1538746 |
| 27 | Q | 59 | 41 | 0 | 3.1 | 0.82 | 11 | 0.12 | 0.8 | 0.64 | 1223 | 16.0 | 65 | 19568 | 1271920 |
| 28 | R* | 53 | 47 | 0 | 3.1 | 0.51* | 14 | 0.10 | 0.8 | 0.62 | 1311 | 9.0 | 75 | 11799* | 884925 |
| 29 | S* | 68 | 32 | 0 | 12.0 | 1.02 | 12 | 0.12 | 1.0 | 0.00 | 1021 | 14.8 | 71 | 15111 | 1072867 |
| 30 | T | 62 | 38 | 0 | 3.3 | 0.92 | 17 | 0.10 | 0.2 | 0.75 | 1187 | 17.3 | 72 | 20535 | 1478527 |
| 31 | U | 69 | 31 | 0 | 3.1 | 0.93 | 11 | 0.14 | 0.2 | 0.56 | 1220 | 17.1 | 65 | 20862 | 1356030 |
| 32 | V | 65 | 35 | 0 | 2.8 | 0.90 | 13 | 0.10 | 0.1 | 0.59 | 1142 | 18.5 | 68 | 21127 | 1436636 |

TABLE 9-continued

| | | Structure | | | | | | | | | Mechanical properties | | | | |
|---|---|---|---|---|---|---|---|---|---|---|---|---|---|---|---|
| | | Area ratio (%) | | | Average grain | | | Existence | Precipitate density (number/μm²) | | | | | | |
| Steel No. | Steel type | α | Hard phase | Other structure | size of α (μm) | $X_{KAM\leq0.4^a}/V_\alpha$ (—) | $X_{KAM=0.6\text{-}0.8^a}$ (%) | form of α (—) | ≥0.1 μm θ | ≥20 Nm MX | TS (MPa) | El (%) | λ (%) | TS × El (MPa · %) | TS × El × λ (MPa · % · %) |
| 33 | W | 62 | 38 | 0 | 3.4 | 0.95 | 12 | 0.11 | 0.2 | 0.51 | 1204 | 16.1 | 81 | 19384 | 1570136 |
| 34 | X | 61 | 39 | 0 | 3.3 | 0.97 | 16 | 0.12 | 0.7 | 0.56 | 993 | 19.8 | 73 | 19661 | 1435282 |
| 35 | A | 59 | 41 | 0 | 2.6 | 0.91 | 15 | 0.11 | 0.66 | 0.05 | 1036 | 18.5 | 98 | 19166 | 1878268 |
| 36 | A | 63 | 37 | 0 | 2.4 | 0.94 | 15 | 0.12 | 0.79 | 0.04 | 1053 | 19.0 | 94 | 20007 | 1880658 |

*Out of the scope of the present invention,
a: Out of recommended range,
α: ferrite
Other structure: retained austenite + martensite,
θ: cementite,
MX: Carbide/nitride including Nb, Ti and V The present invention is described in detail and referring to specific embodiments. However, it is clear for those skilled in the art that various alterations and modifications can be made without departing from the sprit and scope of the present invention.

This patent application is base on applications of Japanese Patent Application (Application Publication No. 2009-091297) filed Apr. 3, 2009; Japanese Patent Application (Application Publication No. 2009-091298) filed Apr. 3, 2009; Japanese Patent Application (Application Publication No. 2009-231680) filed Oct. 5, 2009 and Japanese Patent Application (Application Publication No. 2009-231681) filed Oct. 5, 2009, and the entire disclosures of which are incorporated herein by reference.

INDUSTRIAL APPLICABILITY

The present invention can be applied to a cold-rolled steel sheet used for automotive parts and the like.

The invention claimed is:

1. A cold-rolled steel sheet comprising:

a component composition, comprising, in terms of % by mass:

iron,

C: 0.05-0.30%,

Si: 3.0% or less (including 0%),

Mn: 0.1-5.0%,

P: 0.1% or less (including 0%),

S: 0.010% or less (including 0%) and

Al: 0.001-0.10%; and having a structure, comprising, in terms of area ratio:

10-80% of ferrite as a soft phase;

less than 5% (including 0%) of a sum of retained austenite, martensite and a mixed structure of retained austenite and martensite; and a hard phase comprising at least one tempered substance selected from the group consisting of tempered martensite and tempered bainite;

wherein, in a frequency distribution curve of a Kernel Average Misorientation value (KAM value), a relation between a proportion of frequency having a KAM value of 0.4° or less to a total frequency $X_{KAM\leq0.4°}$ (unit: %) and an area ratio of ferrite $V_\alpha$ (unit: %) satisfies $X_{KAM\leq0.4°}/V_\alpha\geq0.8$; and a proportion of frequency having a KAM value of 0.6-0.8° to a total frequency $X_{KAM=0.6\text{-}0.80°}$ is 10-20%; and wherein a dispersion state of cementite grains having an equivalent circle diameter of 0.1 μm or more and existing at an interface between the ferrite and the hard phase is three grains or less per 1 μm² of the hard phase.

2. The cold-rolled steel sheet according to claim 1, wherein the component composition further comprises one or more of Nb: 0.02-0.40%;

Ti: 0.01-0.20%; and

V: 0.01-0.20%;

wherein a range of ([% Nb]/96+[% Ti]/51+[% V]/48)×48 is 0.01-0.20%;

wherein an average grain size of the ferrite is 5 μm or less in an equivalent circle diameter; and a distribution state of precipitate existing at an interface between the ferrite and the hard phase, having an equivalent circle diameter of 20 nm or more and comprising one or more of Nb, Ti and V is five precipitate grains or less per 1 μm² of the hard phase.

3. The cold-rolled steel sheet according to claim 1, further comprising Cr: 0.01-1.0%.

4. The cold-rolled steel sheet according to claim 1, wherein the component composition further comprises one or more of Mo: 0.02-1.0%, Cu: 0.05-1.0% and Ni: 0.05-1.0%.

5. The cold-rolled steel sheet according to claim 1, further comprising at least one substance from the group consisting of Ca: 0.0005-0.01% and Mg: 0.0005-0.01%.

6. A method for manufacturing a cold-rolled steel sheet, comprising:

hot rolling a steel material comprising the component composition of claim 1 under hot-rolling conditions of finish temperature of finish rolling equal to or more than an Arg point and take-up temperature within a range of 450-700° C., to obtain a hot-rolled steel sheet;

cold rolling the hot-rolled steel sheet under a cold rolling ratio of 20-80%, to obtain a cold-rolled steel sheet;

annealing the cold-rolled steel sheet under annealing conditions wherein, after rising temperature in a temperature zone of 600-Ac1° C. by a temperature rising pattern which satisfies both of Formula I and Formula II and retaining for an annealing retention time of 3600 s or less at an annealing heating temperature of [(8×Ac1+2×Ac3)/10]−1000° C., the cold-rolled steel sheet is rapidly cooled in a first cooling rate selected from the group of cooling rates consisting of 50° C./s or more from the annealing heating temperature to a temperature of Ms point or lower directly and a cooling rate of 1° C./s or more and less than 50° C./s from the annealing heating temperature to a first cooling finish temperature of lower than the annealing heating temperature and 600° C. or more and then is rapidly cooled in a second cooling rate of 50° C./s or less to the temperature of Ms point or lower (referred to as "second cooling finish temperature"), to obtain an annealed steel sheet; and tempering the annealed steel sheet under tempering conditions wherein the annealed steel sheet is heated at a heating rate exceeding 5° C./s between a temperature after the annealing cooling to a tempering temperature between 420° C. or more and lower than 670° C., and a tempering retention time which exists in a temperature range between the tempering heating temperature and 10° C. below the tempering heating temperature is set to 30 s or less and then cooled in a cooling rate exceeding 5° C./s, wherein Formula I is $$X = 1 - \exp\left(-\left(\int_{t_{600°C.}}^{t_{Ac1}} (\exp(0.8\ln(D_{Fe}) + 1.8\ln(\rho_o) - 33.7))^{1/0.58} \cdot dt\right)^{0.58}\right) \geqq 0.8$$

wherein $$D_{Fe} = 0.0118 \cdot \exp\left(-\frac{281500}{8.314 \cdot (T(t) + 273)}\right)$$

$$\rho_o = 1.54 \times 10^{15} \cdot \ln\left(-\ln\left(\frac{100 - [CR]}{100}\right)\right) + 2.51 \times 10^{14}$$

and $$r = \left(\int_{t_{600°C.}}^{t_{Ac1}} 0.5 \cdot \exp\left(-\frac{80220}{8.314 \cdot (T(t) + 273)}\right) \cdot dt + r_0^3\right)^{\frac{1}{3}} \leqq 0.19$$

wherein X is a Recrystallization ratio, $D_{Fe}$ is a Self diffusion ratio of iron in ($m^2/s$), po is an Initial transition density in ($m/m^3$), t is Time in (s), $t_{Ac1}$ is Time at point reached to Ac1 point in (s), T(t) is Temperature at time t in (° C.), [CR] is a Cold rolling ratio (% by mass), r is a Radius of cementite grain, and $r_0$ is Initial radius of cementite grain (μm).

7. A method for manufacturing a cold-rolled steel sheet comprising:

hot rolling a steel material comprising the component composition of claim 2 under hot-rolling conditions of finish temperature of finish rolling of at least 900° C., cooling time to 550° C. of [finish temperature of finish rolling-550° C.)/20] s or less and take-up temperature of 500° C. or less, to obtain a hot-rolled steel sheet;

cold rolling the hot-rolled steel sheet under a cold rolling ratio of 20-80% to obtain a cold-rolled steel sheet;

annealing the cold-rolled steel sheet under annealing conditions wherein, after rising temperature in a temperature zone of 600-Ac1° C. by a temperature rising pattern which satisfies both of Formula I' and Formula II' and retaining for annealing retention time of 3600 s or less at an annealing heating temperature of [(8×Ac1+2×Ac3)/10]−1000° C., the cold-rolled steel sheet is rapidly cooled in a first cooling rate selected from the group of cooling rates consisting of 50° C./s or more from the annealing heating temperature to a temperature of Ms point or lower directly and 1° C./s or more and less than 50° C./s from the annealing heating temperature to a first cooling finish temperature of lower than the annealing heating temperature and 600° C. or more and then is rapidly cooled in a second cooling rate of 50° C./s or less to a second cooling finish temperature of Ms point or lower, to obtain an annealed steel sheet; and tempering the annealed steel sheet under tempering conditions Formula II is :

wherein the annealed steel sheet is heated at a heating rate exceeding 5° C./s between a temperature after the annealing cooling to a tempering temperature between 420° C. or more and lower than 670° C., and a tempering retention time which exists in a temperature range between the tempering heating temperature and 10° C. below the tempering heating temperature is set to 20 s or less and then cooled in a cooling rate exceeding 5° C./s wherein Formula I' is $$X = 1 - \exp\left(-\left(\int_{t_{600°C.}}^{t_{Ac1}} (\exp(0.82\ln(D_{Fe}) + 1.8\ln(\rho_o) - 34.2))^{1/0.58} \cdot dt\right)^{0.58}\right)$$

$$\geqq 0.8$$

wherein $$D_{Fe} = 0.0118 \cdot \exp\left(-\frac{281500}{8.314 \cdot (T(t) + 273)}\right)$$

$$\rho_o = 1.54 \times 10^{15} \cdot \ln\left(-\ln\left(\frac{100 - [CR]}{100}\right)\right) + 2.51 \times 10^{14}$$

and $$r = \left(\int_{t_{600°C.}}^{t_{Ac1}} 0.5 \cdot \exp\left(-\frac{80220}{8.314 \cdot (T(t) + 273)}\right) \cdot dt + r_0^3\right)^{\frac{1}{3}}$$

$$\leqq 0.19$$

Formula II′ is wherein X is a Recrystallization ratio, $D_{Fe}$ is a Self diffusion ratio of iron in ($m^2/s$), po is an Initial transition density in ($m/m^3$), t is Time in (s), $t_{Ac1}$ is Time at point reached to Ac1 point in (s), T(t) is Temperature at time t in (° C.), [CR] is a Cold rolling ratio (% by mass), r is a Radius of cementite grain, and $r_0$ is Initial radius of cementite grain (μm).

8. The cold-rolled steel sheet according to claim 2, further comprising

Cr: 0.01-1.0% by mass.

9. The cold-rolled steel sheet according to claim 2, wherein the component composition further comprises one or more of Mo: 0.02-1.0%, Cu: 0.05-1.0% and Ni: 0.05-1.0% by mass.

10. The cold-rolled steel sheet according to claim 2, further comprising at least one substance selected from the group consisting of Ca: 0.0005-0.01% and Mg: 0.0005-0.01% by mass.

11. The cold-rolled steel sheet according to claim 1, comprising C: 0.14 to 0.2%.

12. The cold-rolled sheet according to claim 1, comprising Si: 1-2.2%.

13. The cold-rolled sheet according to claim 1, comprising Mn: 1.2-2.2%.

14. The cold-rolled sheet according to claim 1, comprising 10-60% ferrite as a soft phase.

15. The cold-rolled sheet according to claim 1, comprising 0% of a sum of retained austenite, martensite and a mixed structure of retained austenite and martensite.

16. The cold-rolled sheet according to claim 1, wherein the relation between a proportion of frequency having a KAM value of 0.4° or less to a total frequency $X_{KAM \leq 0.4°}$ (unit: %) and an area ratio of ferrite $V_\alpha$ (unit: %) satisfies $X_{KAM \leq 0.4°}/V_\alpha \geq 1.1$.

17. The cold-rolled sheet according to claim 1, wherein the proportion of frequency having a KAM value of 0.6-0.8° to a total frequency $X_{KAM=0.6\text{-}0.80°}$ is 13-16%.

18. The cold-rolled sheet according to claim 1, having a structure, after tempering, in terms of area ratio:

10-80% of ferrite as a soft phase;

less than 5% (including 0%) of a sum of retained austenite, martensite and a mixed structure of retained austenite and martensite; and a hard phase comprising at least one tempered substance selected from the group consisting of tempered martensite and tempered bainite;

wherein, in a frequency distribution curve of a Kernel Average Misorientation value (KAM value), a relation between a proportion of frequency having a KAM value of 0.4° or less to a total frequency $X_{KAM \leq 0.4°}$ (unit: %) and an area ratio of ferrite $V_\alpha$ (unit: %) satisfies $X_{KAM \leq 0.4°}/V_\alpha \geq 0.8$; and a proportion of frequency having a KAM value of 0.6-0.8° to a total frequency $X_{KAM=0.6\text{-}0.80°}$ is 10-20%.

* * * * *